US007573440B2

(12) United States Patent
Sasaki et al.

(10) Patent No.: US 7,573,440 B2
(45) **Date of Patent: *Aug. 11, 2009**

(54) DRIVING METHOD OF PLASMA DISPLAY PANEL AND PLASMA DISPLAY DEVICE

(75) Inventors: Takashi Sasaki, Hiratsuka (JP); Takayuki Kobayashi, Machida (JP); Naoki Itokawa, Kawasaki (JP)

(73) Assignee: Fujitsu Hitachi Plasma Display Limited, Kanagawa (JP)

( * ) Notice: Subject to any disclaimer, the term of this patent is extended or adjusted under 35 U.S.C. 154(b) by 635 days.

This patent is subject to a terminal disclaimer.

(21) Appl. No.: 11/327,501

(22) Filed: Jan. 9, 2006

(65) Prior Publication Data

US 2006/0152445 A1 Jul. 13, 2006

(30) Foreign Application Priority Data

Jan. 11, 2005 (JP) ..... 2005-003690

(51) Int. Cl.
*G09G 3/28* (2006.01)

(52) U.S. Cl. ..... 345/60; 345/63; 345/169.4

(58) Field of Classification Search ..... 345/41–42, 345/60–71; 315/169.1–169.4
See application file for complete search history.

(56) References Cited

U.S. PATENT DOCUMENTS 6,144,348 A * 11/2000 Kanazawa et al. ..... 345/60
6,243,084 B1 * 6/2001 Nagai ..... 345/210
6,512,500 B2 * 1/2003 Sasaki et al. ..... 345/60
2003/0132898 A1 7/2003 Akiba

FOREIGN PATENT DOCUMENTS

| | | |
|---|---|---|
| CN | 1424739 | 6/2003 |
| JP | 2000-123741 | 4/2000 |
| JP | 2001-034228 | 2/2001 |
| JP | 2003-337566 | 11/2003 |
| JP | 2004-192875 | 7/2004 |

* cited by examiner

*Primary Examiner*—Richard Hjerpe
*Assistant Examiner*—Mansour M Said
(74) *Attorney, Agent, or Firm*—Antonelli, Terry, Stout & Kraus, LLP.

(57) ABSTRACT

In a plasma display device comprising: plural first, second, and third electrodes disposed adjacently and extending in a first direction, the third electrodes being provided between the first and second electrodes for repeating discharges; a dielectric layer covering the electrodes; a first electrode driving circuit for driving the first electrodes; a second electrode driving circuit for driving the second electrodes; and a third electrode driving circuit for driving the third electrodes, gray-scale display is performed by a sub-field method, and the third electrodes are set to have a potential approximately the same as that of the first or second electrode at the discharge in the repetitive discharges. In this plasma display device, the third electrode driving circuit makes the third electrode operate as an anode at least once at least in one sub-field from minimum luminance and makes it operate as a cathode in the rest thereof.

13 Claims, 17 Drawing Sheets

(VERTICAL DERECTION)

(LATERAL DERECTION)

DRIVING METHOD OF PLASMA DISPLAY PANEL AND PLASMA DISPLAY DEVICE

CROSS-REFERENCE TO RELATED APPLICATION

The present application claims priority from Japanese Patent Application No. JP 2005-3690 filed on Jan. 11, 2005, the content of which is hereby incorporated by reference into this application.

TECHNICAL FIELD OF THE INVENTION

The present invention relates to an A/C plasma display panel (PDP) used for a display device of a personal computer and a workstation, a flat TV, and a plasma display for displaying advertisements, information, and others.

BACKGROUND OF THE INVENTION

In AC color PDP devices, an address/display separation (ADS) method in which a period when the cells to be displayed are determined (address period) and a display period when discharges for display lighting are performed (sustain period) are separated is widely employed. In this method, charge is accumulated in the cells, which are to be turned on, in the address period, and discharges for display are performed by utilizing the charge in the sustain period.

Also, plasma display panels include: a two-electrode type PDP in which a plurality of first electrodes extending in a first direction are provided in parallel to each other and a plurality of second electrodes extending in a second direction which is perpendicular to the first direction are provided in parallel to each other; and a three-electrode type PDP in which a plurality of first electrodes and second electrodes extending in a first direction are alternately provided in parallel to each other and a plurality of address electrodes extending in a second direction perpendicular to the first direction are provided in parallel to each other. In recent years, the three-electrode type PDPs have been widely used.

In a general structure of the three-electrode type PDPs, first (X) electrodes and second (Y) electrodes are alternately provided in parallel to each other on a first substrate, address electrodes extending in a direction which is perpendicular to the extending direction of the first and second electrodes are provided on a second substrate opposite to the first substrate, and the surfaces of the electrodes are covered by dielectric layers. On the second substrate, barrier ribs which are extending in one direction and arranged in stripes between the address electrodes in parallel to the address electrodes or barrier ribs which are arranged in lattice pattern and disposed in parallel to the address electrodes and the first and second electrodes so as to individually separate the cells are further provided, and the first and the second substrates are attached to each other after phosphor layers are formed between the barrier ribs. Therefore, the dielectric layers and the phosphor layers and further the barrier ribs are formed on the address electrodes.

Discharges are caused in all of the cells by applying voltage between the first and second electrodes to make the charge (wall charge) in the vicinity of the electrodes uniform. Then, the addressing for selectively leaving the wall charge in the cells to be turned on is performed by sequentially applying scan pulses to the second electrodes and applying address pulses to the address electrodes in synchronization with the scan pulses. Subsequently, sustain discharge (sustain) pulses of potentials of alternately changed polarities are applied between the two adjacent first and second electrodes where discharges are to be performed. By doing so, the sustain discharges are performed in the cells to be turned on in which the wall charge has been formed through the addressing, thereby performing the lighting. The phosphor layers emit light by ultraviolet rays generated through the discharges, and the light is seen through the first substrate. Therefore, the first and second electrodes are comprised of non-transparent bus electrodes formed of metal materials and transparent electrodes such as ITO films, and the light generated in the phosphor layers can be seen through the transparent electrodes. Since structures and operations of general PDPs are widely known, detailed descriptions thereof will be omitted here.

In the field of the above-described three-electrode type PDP, various types of PDPs in which third electrodes are respectively provided between the first electrodes and the second electrodes in parallel thereto have been proposed.

For example, Japanese Patent Application Laid-Open Publication No. 2000-123741 (Patent Document 1) discloses a PDP device which performs interlaced display by utilizing display lines between first electrodes and third electrodes and between second electrodes and third electrodes.

Furthermore, Japanese Patent Application Laid-Open Publication No. 2001-34228 (Patent Document 2) and No. 2004-192875 (Patent Document 3) disclose the structure in which third electrodes are provided between first electrodes and second electrodes where discharge is not performed (non-display line) so that the third electrodes are utilized for trigger operations, prevention of discharges in non-display lines (prevention of reverse slit), reset operations, and others.

In general, the three-electrode type PDPs merely control lighting and non-lighting, and it is difficult to carry out grayscale display by precisely changing the light emission intensity. Therefore, in PDP devices, one display field is comprised of a plurality of sub-fields in general, and the grayscale display is carried out by combining the lighting sub-fields. The grayscales which can be displayed in this case correspond to combinations of luminance of the sub-fields. For example, if 8 sub-fields in which a luminance ratio is sequentially changed in the powers of 2 are provided, display of 256 grayscales can be carried out. Although this sub-field structure is the most efficient structure in terms of the relation between the number of sub-fields and the number of grayscales which can be displayed, it has a problem of, for example, the color drift and edge distortion. Therefore, various sub-field structures for reducing the color drift and edge distortion have been proposed.

As described above, various sub-field structures have been proposed. However, in the grayscale display using conventional sub-field structures, the light emission amount of one sustain discharge is almost constant except for luminance saturation in the case where the number of discharges is increased, and the luminance ratio of sub-fields is determined by the ratio of the numbers of sustain discharge pulses. In addition to this, compensation for the decrease in luminance due to the luminance saturation or the like is added so as to achieve a linear relation between the displayed grayscales and luminance.

Meanwhile, Japanese Patent Application Laid-Open Publication No. 2003-337566 (Patent Document 4) discloses a structure in which second (Y) electrodes are sorted into primary second electrodes and auxiliary second electrodes which are selectively used, and by selecting the second electrode to be used, the discharge area can be changed in each display line so as to change the luminance. When this structure is applied to the sub-field structure, the number of grayscales which can be displayed is increased.

SUMMARY OF THE INVENTION

Human eyes are more sensitive to luminance variations in low grayscale displays than that in high grayscale displays, and when the amount of luminance variations between grayscales is constant, luminance variations are more noticeable in low grayscale displays. In other words, since human eyes respond to the luminance in a logarithmically converted manner, the difference in luminance is large in the low grayscale display and is small in the high grayscale display for human eyes even though the difference in luminance is the same. However, in conventional plasma display devices, since they are designed so that grayscales and luminance have linear relation, the luminance difference of one grayscale is the same both in the low grayscales and high grayscales. Consequently, even when the number of changes in the grayscales is the same, the luminance change is rough in low grayscales and fine in high grayscales. Accordingly, there is a problem in displays in low grayscales.

The present invention is to realize a novel driving method of a plasma display panel which improves displays in low grayscales, and an object of the present invention is to improve a grayscale-luminance property in low grayscales in a plasma display device side.

In order to realize the above-described object, in the driving method of a plasma display panel (PDP) of the present invention in which third electrodes (Z) are provided between first (X) electrodes and second (Y) electrodes which perform discharges, and grayscale displays are carried out by means of a sub-field method in which the numbers of repeated discharges are allotted to sub-fields in accordance with luminance ratio in the three-electrode type PDP, at least one sub-field from the sub-field of minimum luminance has luminance lower than the luminance corresponding to the number of repeated discharges.

More specifically, in a driving method of a plasma display panel according to the present invention, the plasma display panel comprises: a plurality of first, second, and third electrodes which are disposed to be adjacent to each other and extending in a first direction, the third electrodes being provided respectively between the first and second electrodes between which discharges are to be repeated; and a dielectric layer which covers the plurality of first, second, and third electrodes, grayscale display is carried out by means of a sub-field method in which the numbers of repeated discharges are allotted to sub-fields in accordance with a luminance ratio, and at least one sub-field from the sub-field of minimum luminance has luminance lower than luminance corresponding to the number of the repeated discharges.

By virtue of such a structure, the difference in luminance with respect to the difference in grayscale is relatively reduced in low grayscales, and grayscale displays in low grayscales are improved.

FIG. 1 is a diagram showing a conventional relation between grayscales and luminance in low grayscales and a relation between grayscales and luminance in low grayscales of the present invention. In this diagram, the straight line denoted by A represents the conventional relation between grayscales and luminance, and the line denoted by B represents the relation between grayscales and luminance of the present invention. As shown in FIG. 1, the conventional relation between grayscales and luminance exhibits a linear property. On the other hand, in the relation between grayscales and luminance of the present invention, the luminance is lower with respect to the grayscales up to certain luminance when compared with the conventional relation. In other words, the line is curved downwardly in comparison with the straight line representing the conventional relation between grayscales and luminance.

The above-described grayscale/luminance property can be realized with a simple structure when at least one repeated discharge is a discharge in which the third electrodes operate as anodes, and the rest of the repeated discharges are discharges in which the third electrodes operate as cathodes, in at least one sub-field from the sub-field of minimum luminance.

More specifically, a driving method of a plasma display panel (PDP) of the present invention is a driving method of the plasma display panel comprising: a plurality of first and second electrodes which are provided in approximately parallel so as to be adjacent to each other and perform repeated discharges between the adjacent electrodes; a plurality of third electrodes respectively provided between the first and second electrodes for performing the repeated discharges; and a dielectric layer covering the plurality of first, second, and third electrodes. In the driving method of a plasma display panel, grayscale display by means of sub-field method is performed, the third electrodes are set to have a potential approximately equal to the potential of either one of the first and second electrodes at least at the discharges in a period when the repeated discharges are performed between the first and second electrodes, and at least one of the repeated discharges is a discharge in which the third electrodes operate as anode and the rest of the discharges are discharges in which the third electrodes operate as cathodes, in at least one sub-field from the sub-field of minimum luminance.

In a conventional PDP, first and second electrodes have been comprised of first and second bus electrodes extending in parallel to each other and transparent first and second discharge electrodes which are provided so as to be connected to the first and second bus electrodes in each cell. In sustain discharges in this structure, sustain pulses having alternately changed polarities are repeatedly applied to the first and second electrodes so as to generate sustain discharges. In other words, the first electrode becomes an anode and a cathode alternately, and similarly, the second electrode also becomes a cathode and an anode alternately. Therefore, in conventional PDPs, in consideration of the symmetric property of discharges, the first discharge electrode and the second discharge electrode have the same shape. Also in the structure disclosed in Patent Document 4, the discharge area changes depending on which one is selected from the primary second electrode and the auxiliary second electrode and the luminance also changes, and the selected primary electrode or the auxiliary second electrode becomes a cathode and an anode alternately.

The inventors of the present invention have carried out an experiment about the relation between the area ratio of the anode to the cathode and the amount of emitted light in a discharge, and found out that the amount of emitted light is large when the area of the cathode is larger than the area of the anode. Specifically, when the case where the area ratio of the discharge area of the cathode to the discharge area of the anode is 3:1 is compared with the case where the ratio is 1:3, visible light of about 1.5 times that of the other case is outputted in the case where the cathode area is larger. Therefore, it is conceived that, in a discharge, the light emission amount of a cathode is about twice that of an anode.

Therefore, in a sustain discharge period, the luminance is increased if the third electrodes are operated as cathodes, and the luminance is decreased if the third electrodes are operated as anodes. For example, in the case where a discharge is to be performed with using the first (X) electrode as a cathode and the second (Y) electrode as an anode, when the discharge is performed with using the third (Z) electrode also as a cathode, the discharge is performed with a large light emission amount, in which a large area of the combination of the first electrode and the third electrode serves as a cathode. Inversely, when the discharge is performed with using the third electrode as an anode, the light emission amount is reduced, since only the first electrode is a cathode and the large area of the combination of the second electrode and the third electrode serves as an anode. The principle is true of the case where a discharge is performed with using the first (X) electrode as an anode and the second (Y) electrode as a cathode.

In the present invention, in at least one sub-field from the sub-field of minimum luminance, at least one repeated discharge is a discharge in which the third electrodes operate as anodes, and the rest of the repeated discharges are discharges in which the third electrodes operate as cathodes. Consequently, in the at least one sub-field from the sub-field of minimum luminance, even when the number of sustain discharges is equal to the allotted number of sustain discharges, since the third (Z) electrodes operate as anodes partially in the sustain discharges, the light emission amount is reduced in low grayscales, and the property like that shown in FIG. 1 is obtained.

In sub-fields of high luminance, luminance is not decreased because the third (Z) electrodes operate as cathodes all the time in sustain discharges. Therefore, the highest luminance is reduced by an amount corresponding to decrease of luminance in the sub-fields of low luminance. However, the amount is virtually ignorable.

Also it is desired that the ratio of the number of discharges in which the third electrodes operate as anodes to the number of repeated discharges is increased in the sub-field of lower luminance.

In FIG. 1, the line B deviates from the straight line A along with the increase of grayscales from zero, and shows the same luminance as the straight line A again at a grayscale C. The grayscale C corresponds to the sub-field of minimum luminance in which the third electrodes do not operate as anodes in the repeated discharges, that is, the electrodes operate as cathodes all the time. When the grayscale is increased over the grayscale C, the line B is deviated from the straight line A again, but the luminance becomes equal to that of the straight line A again at the respective grayscales corresponding to the combinations of the sub-fields in which the third electrodes operate as cathodes all the time.

In order to simplify the structure of a driving circuit of the third electrodes, it is desired to drive the third electrodes in common. In such a case, a driving voltage similar to the driving voltage applied to the first (X) electrodes is applied thereto in an address period. In a conventional structure, since the first electrodes operate as cathodes at the beginning of the sustain discharge period, the third electrodes also operate as cathodes at the beginning of the sustain discharge period. Therefore, during the sustain discharge period, the third electrodes cannot operate as anodes all the time, and the third electrodes are switched to be operated as anodes from the middle of the period. In order to operate the third electrode as a cathode all the time during the sustain discharge period, the voltage applied to the third electrode has to be changed at the half cycle of the cycle for changing the voltage applied to the first and second electrodes (sustain cycle). More specifically, a voltage that is changed at a frequency twice the sustain frequency has to be applied to the third electrode.

For example, when the third electrode is switched to an anode after a discharge is performed with using the first electrode and the third electrode as cathodes and the second electrode as an anode, negative wall charge is accumulated in the vicinity of the third electrode (on the dielectric layer). At this point, positive wall charge is accumulated in the vicinity of the first electrode, and negative wall charge is accumulated in the vicinity of the second electrode. When a sustain pulse of changed polarity is to be subsequently applied between the first electrode and the second electrode, the third electrode is switched to a cathode again. Thereafter, by repeating the above-described operations, discharges of a large light emission amount in which the third electrode is operated as a cathode all the time can be carried out.

When the third electrode is switched so as to operate as an anode during the sustain discharge period, the third electrode is maintained as a cathode even after a discharge is performed without changing the third electrode to an anode. By doing so, positive wall charge is accumulated in the vicinity of the third electrode. Then, when the sustain pulse of a changed polarity is applied between the first electrode and the second electrode, the third electrode is switched to be an anode. More specifically, the polarity of the potential which is applied to the third electrode at this point is changed at the same cycles as the sustain pulse. When a discharge is generated by this sustain pulse, the third electrode is changed to a cathode, and positive wall charge is accumulated in the vicinity of the third electrode. Thereafter, by changing the voltage applied to the third electrode at a frequency that is twice the frequency of the sustain pulse, the third electrode continues discharge operations as an anode.

When the state where the third electrodes operate as cathodes is to be switched to the state where the third electrodes operate as anodes in the repeated discharge period, the potential of the third electrode is desired to be changed in synchronization with the potential change of the first or second electrodes which subsequently operate as an anode. By doing so, the driving load can be reduced.

Generation of a discharge is delayed from the application of the voltage, the discharge intensity attains a peak value after a certain time, and then, the discharge intensity gradually attenuates to complete the discharge. Ultraviolet rays are generated by the discharge, the ultraviolet rays excite the phosphor to generate visible light, and the light is outputted to outside the panel through the glass substrate. The ultraviolet rays are not outputted to outside since they are absorbed by the glass substrate, and the ultraviolet rays cannot be detected outside the panel. Infrared light is also generated together with the ultraviolet rays by the discharge, and the generation timing of the ultraviolet rays and the infrared light is approximately the same. Therefore, the state variation of the discharge can be detected by measuring the infrared light.

The timing for switching the state of the third (Z) electrode from a cathode to an anode so as to accumulate the charge is desired to be after the discharge is completely finished. In other words, it is preferred that the third (Z) electrode is not switched to an anode during the period when the outputted infrared light is strong. In this case, for example, the third (Z) electrode is switched to an anode at the point when the outputted infrared light is reduced to the intensity that is 10% of the peak intensity.

The sustain discharges are repeatedly performed, and floating charge in the discharge space is small at the beginning of the sustain discharges and the time from application of a voltage until a discharge is generated and the discharge intensity reaches a peak value is long. However, when the sustain discharges are repeated, the floating charge in the discharge space is increased and the time until the discharge intensity reaches the peak value is shortened. Therefore, it is desired that the period in which the third (Z) electrode operates as a cathode all the time is long at the beginning of the repetition, and becomes short after that. This principle is true of the case where sustain discharges are repeated by operating the third (Z) electrode as an anode after operating it as a cathode.

The present invention can be applied not only to a driving method of a normal plasma display panel (PDP) in which first and second electrodes form pairs and sustain discharges are performed between the paired first and second electrodes but also to a driving method of an ALIS PDP disclosed in Japanese Patent No. 2801893 (Patent Document 5) in which sustain discharges are performed between all of a plurality of adjacent first and second electrodes.

According to the present invention, a driving method of a plasma display panel and a plasma display device in which luminance variations in low grayscale part are small can be realized. Accordingly, grayscale displays can be improved by making displays of low-grayscale part fine.

BRIEF DESCRIPTIONS OF THE DRAWINGS

DESCRIPTIONS OF THE PREFERRED EMBODIMENTS

Figure 1:
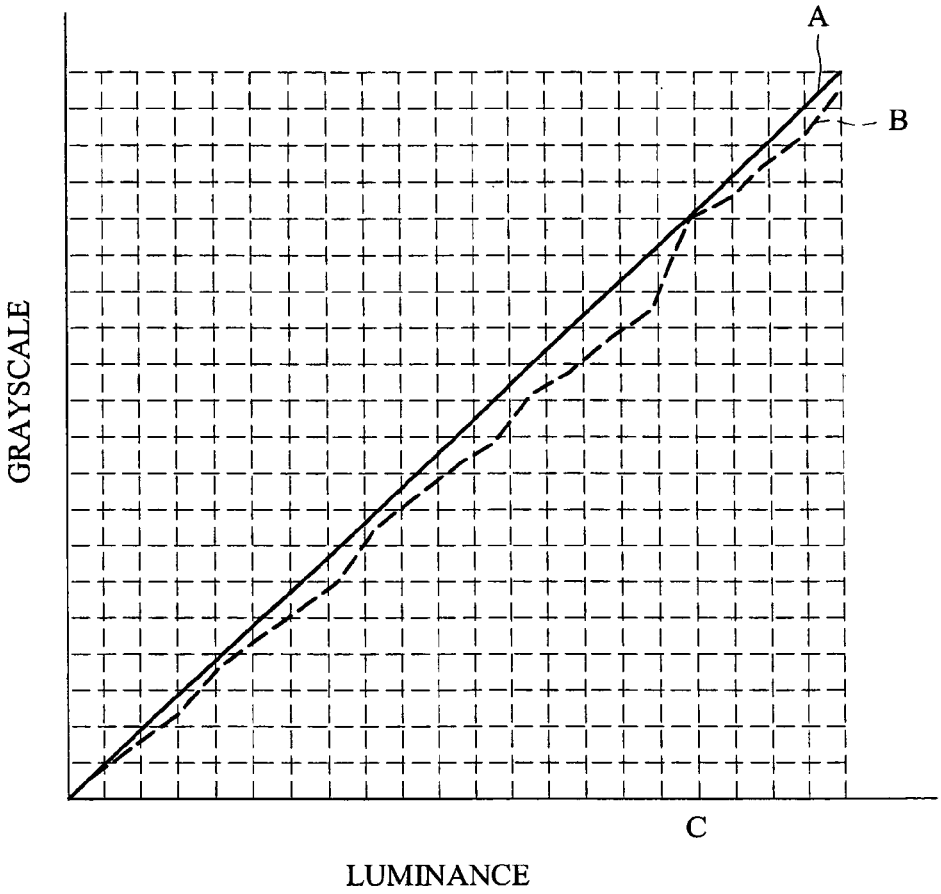
FIG. 1 is a diagram for explaining the principle of the present invention.
Figure 2:
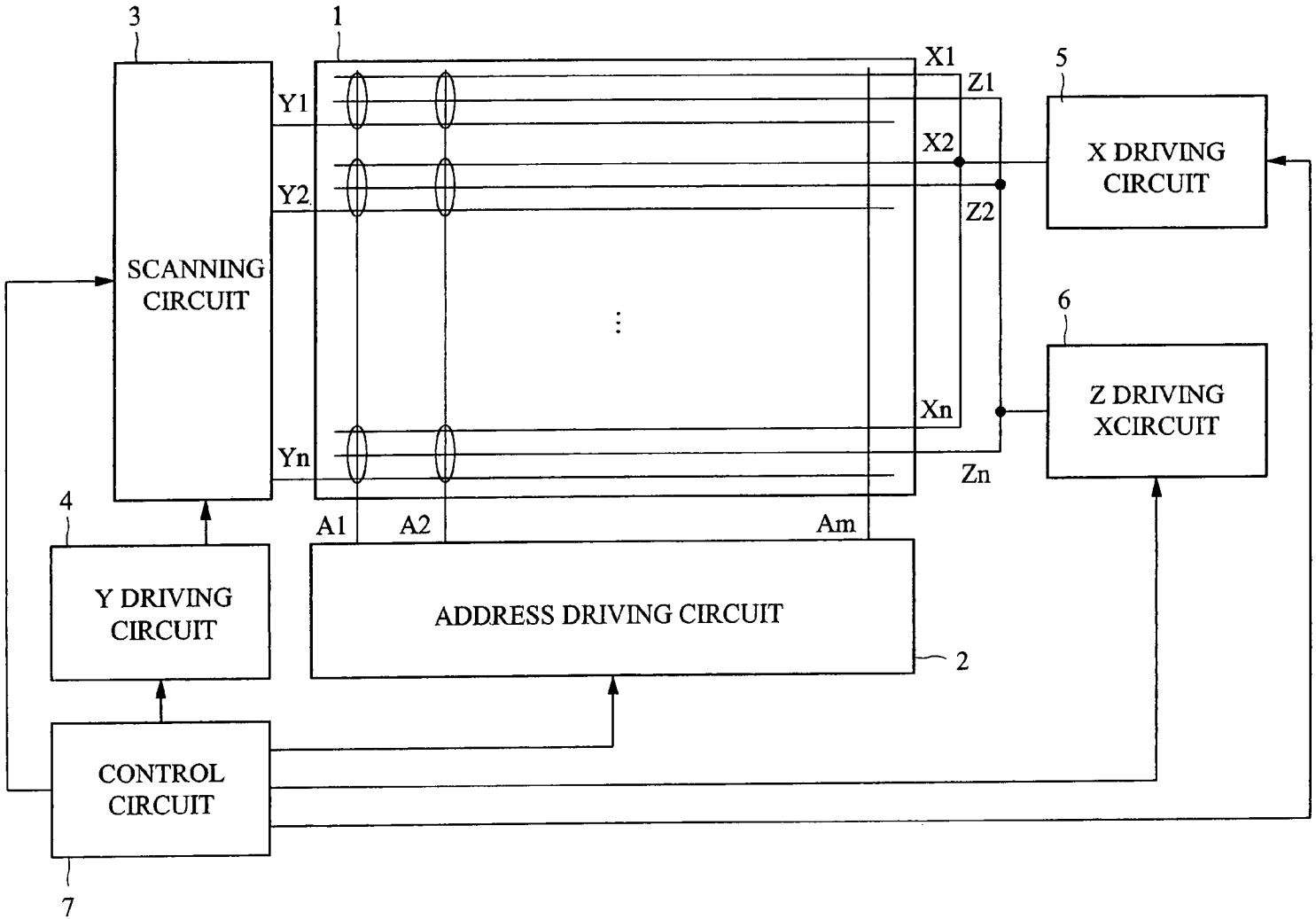
FIG. 2 is a diagram showing the entire structure of a PDP device of a first embodiment of the present invention.

FIG. 2 is a diagram showing the entire structure of a plasma display device (PDP device) of a first embodiment of the present invention. A PDP 1 used in the PDP device of the first embodiment is obtained by applying the present invention to a conventional PDP in which a discharge is performed between a pair of a first (X) electrode and a second (Y) electrode. As shown in FIG. 2, in the PDP 1 of the first embodiment, laterally extending X electrodes X1, X2, . . . , Xn and Y electrodes Y1, Y2, . . . , Yn are alternately disposed, and each of third electrodes Z1, Z2, . . . , Zn is disposed between the X electrode and the Y electrode of each pair. Therefore, n sets of three electrodes, that is, the X electrode, the Y electrode, and the Z electrode are formed. In addition, vertically extending address electrodes A1, A2, . . . , Am are disposed so as to intersect with the n sets of the X electrodes, the Y electrodes, and the Z electrodes, and cells are formed at the intersecting parts. Therefore, n display rows and m display columns are formed.

As shown in FIG. 2, the PDP device of the first embodiment has an address driving circuit 2 which drives the m lines of address electrodes, a scanning circuit 3 which applies scan pulses to the n lines of Y electrodes, a Y driving circuit 4 which applies voltages other than the scanning pulses to the n lines of Y electrodes in common via the scanning circuit 3, an X driving circuit 5 which applies voltages to the n lines of X electrodes in common, a Z driving circuit 6 which applies voltages to the n lines of Z electrodes in common, and a control circuit 7 which controls each of the circuits. The PDP device of the first embodiment is different from the conventional examples in that the Z electrodes are provided in the PDP 1, and the Z driving circuit 6 which drives them is provided, and other parts are the same as the conventional examples. Therefore, only the parts relating to the Z electrodes will be described here, and descriptions of other parts will be omitted.

Figure 3:
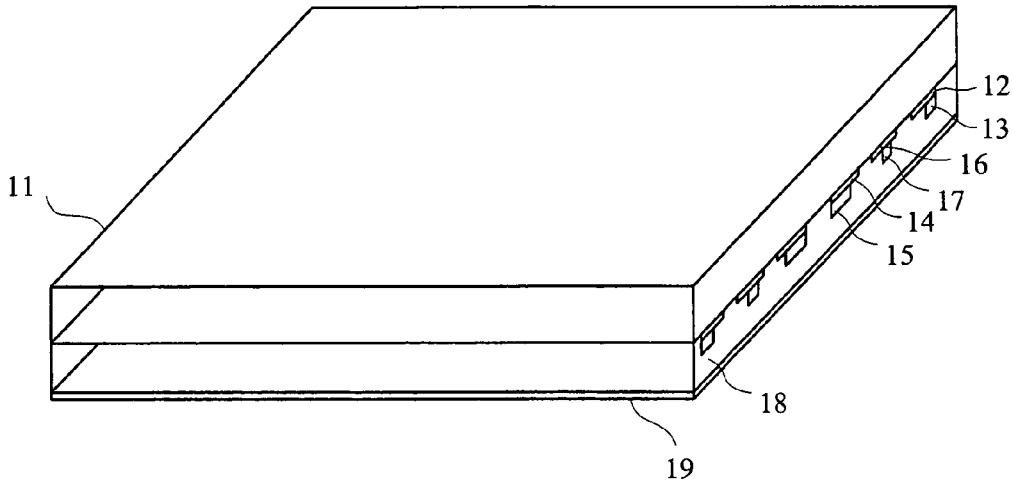
FIG. 3 is an exploded perspective view of the PDP of the first embodiment.
Figure 3:
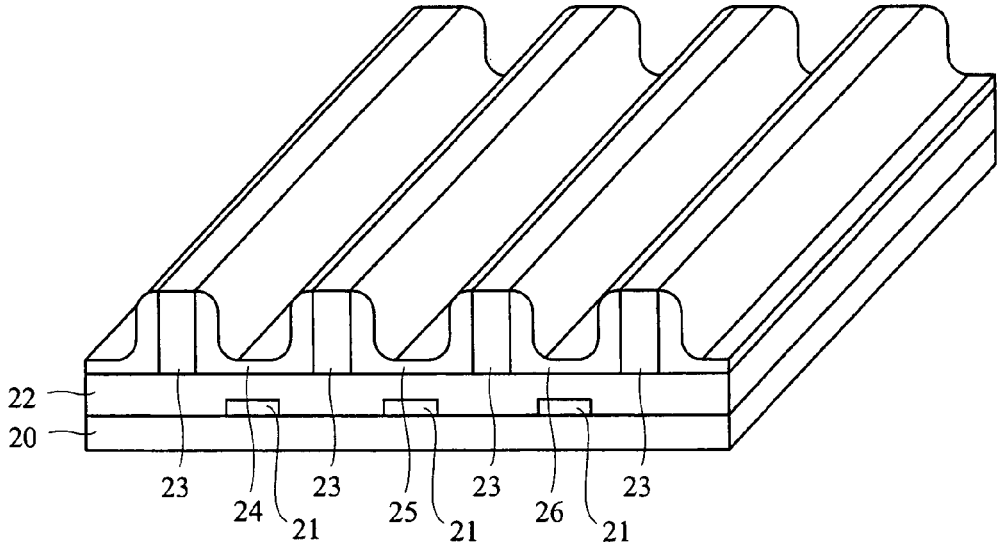

FIG. 3 is an exploded perspective view of the PDP of the first embodiment. As shown in FIG. 3, on a front (first) glass substrate 11, laterally extending first (X) bus electrodes 13 and second (Y) bus electrodes 15 are alternately disposed in parallel to each other so as to form pairs. X and Y optically transparent electrodes (discharge electrodes) 12 and 14 are provided so as to be overlapped over the X and Y bus electrodes 13 and 15, and parts of the X and Y discharge electrodes 12 and 14 are extending toward the side of the opposing electrodes. A third discharge electrode 16 and a third bus electrode 17 overlapped with each other are provided between the X and Y bus electrodes 13 and 15 of each pair. For example, the bus electrodes 13, 15, and 17 are formed of metal layers and the discharge electrodes 12, 14, and 16 are formed of ITO films or the like, and the resistance values of the bus electrodes 13, 15, and 17 are lower than or equal to the resistance values of the discharge electrodes 12, 14, and 16. Hereinafter, the parts of the X and Y discharge electrodes 12 and 14 extending from the X and Y bus electrodes 13 and 15 will be simply referred to as X and Y discharge electrodes 12 and 14, respectively, and the third discharge electrode 16 and the third bus electrode 17 will be together referred to as a third electrode.

On the discharge electrodes 12, 14, and 16 and the bus electrodes 13, 15, and 17, a dielectric layer 18 is formed so as to cover the electrodes. The dielectric layer 18 is made of $SiO_2$ or the like through which visible light can pass and it is formed by the vapor deposition method, and a protective layer 19 of MgO or the like is further formed on the dielectric layer 18. The protective layer 19 has effects of reducing discharge voltages, reducing discharge delay, and others by emitting electrons through ion bombardment to accelerate discharges. Since all of the electrodes are covered with the protective layer 19 in this structure, discharges utilizing the effects of the protective layer can be performed regardless which electrode group becomes a cathode. The glass substrate 11 having the above-described structure is utilized as a front substrate, and display is seen through the glass substrate 11.

Meanwhile, address electrodes 21 are provided on a rear (second) substrate 20 so as to intersect with the bus electrodes 13, 15, and 17. For example, the address electrodes 21 are formed of metal layers. On the group of the address electrodes, a dielectric layer 22 is formed, and vertical barrier ribs 23 are formed on the dielectric layer 22. In addition, phosphor layers 24, 25, and 26 which emit visible light of red, green, and blue when excited by the ultraviolet rays generated upon discharges are coated on the side surfaces and bottom surfaces of the grooves formed by the barrier ribs 23 and the dielectric layer 22.

Figure 4A:
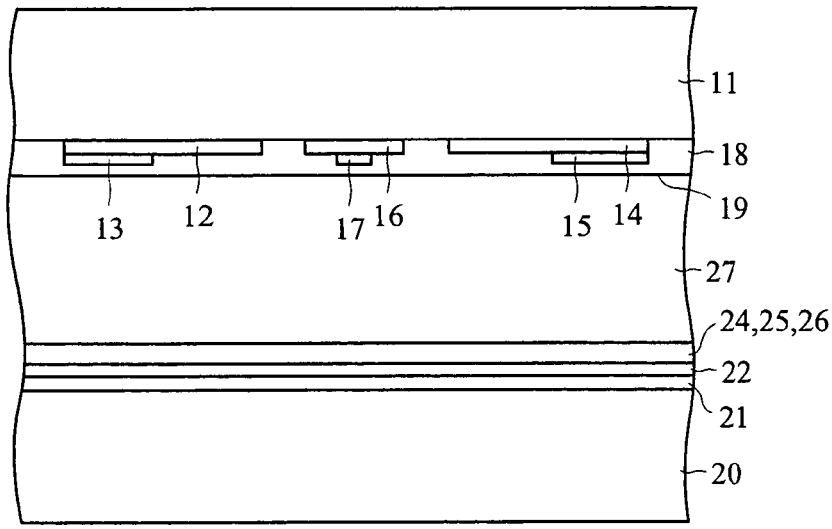
FIG. 4A is a cross-sectional view of the PDP of the first embodiment.
Figure 4B:
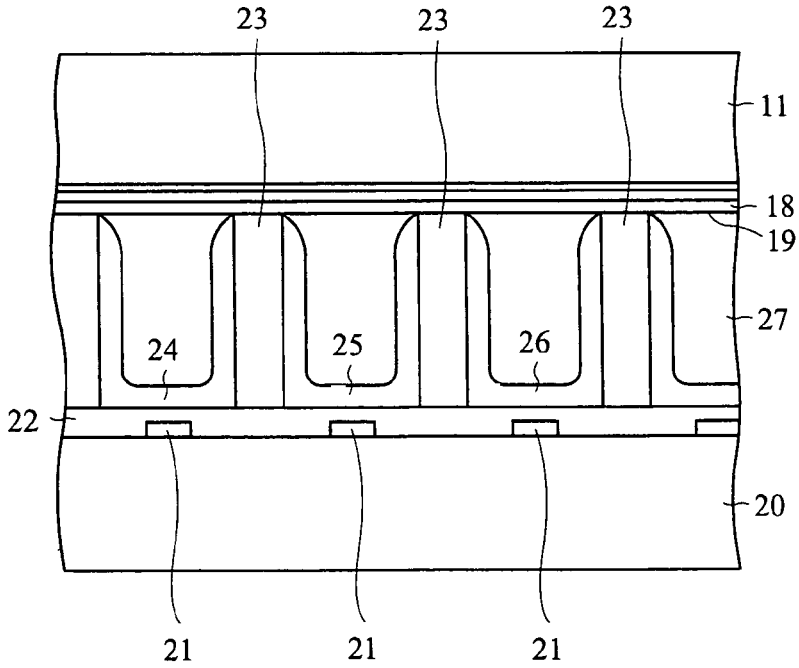
FIG. 4B is a cross-sectional view of the PDP of the first embodiment.

FIG. 4A and FIG. 4B are partial cross-sectional views of the PDP 1 of the first embodiment, wherein FIG. 4A is a vertical cross-sectional view, and FIG. 4B is a lateral cross-sectional view. Discharge gases such as Ne, Xe, and He are sealed in discharge spaces 27 between the front substrate 11 and the rear substrate 20, which are divided by the barrier ribs 23.

Figure 5:
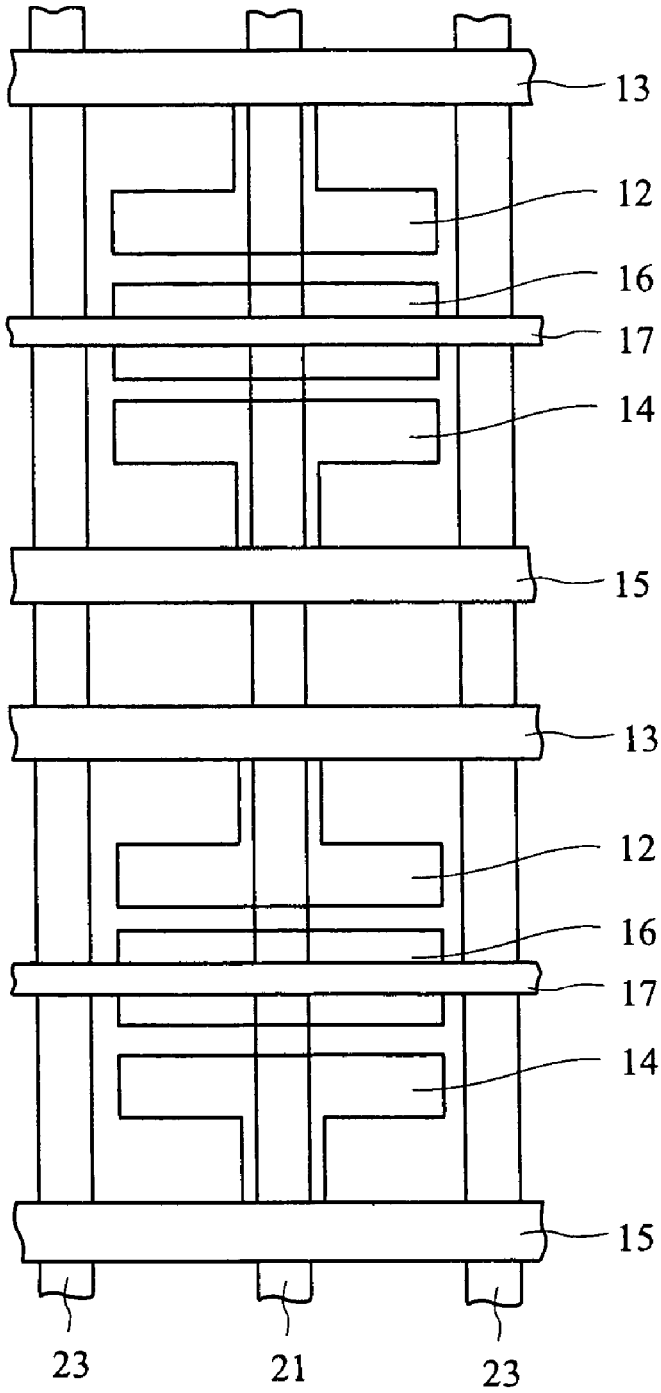
FIG. 5 is a diagram showing the shapes of the electrodes of the first embodiment.

FIG. 5 is a diagram showing the shapes of the electrodes of two upper and lower cells. As shown in the diagram, the X bus electrode 13 and the Y bus electrode 15 are disposed in parallel to each other, and the Z bus electrode 17 is disposed in parallel to them at the center between them. In addition, the barrier ribs 23 extending in the direction perpendicular to the bus electrodes 13, 15, and 17 are disposed. The address electrode 21 is disposed between the barrier ribs 23. In each section divided by the barrier ribs 23, the T-shaped X discharge electrodes 12 extending from the X bus electrodes 13, the T-shaped Y discharge electrodes 14 extending from the Y bus electrodes 15, and the Z discharge electrodes 16 extending toward both the upper and lower sides from the Z bus electrodes 17 are provided. The opposing edges of the X discharge electrodes 12 and the Z discharge electrodes 16 and the opposing edges of the Y discharge electrodes 14 and the Z discharge electrodes 16 are parallel to the extending direction of the bus electrodes 13, 15, and 17, and the distances therebetween are constant.

Figure 6:
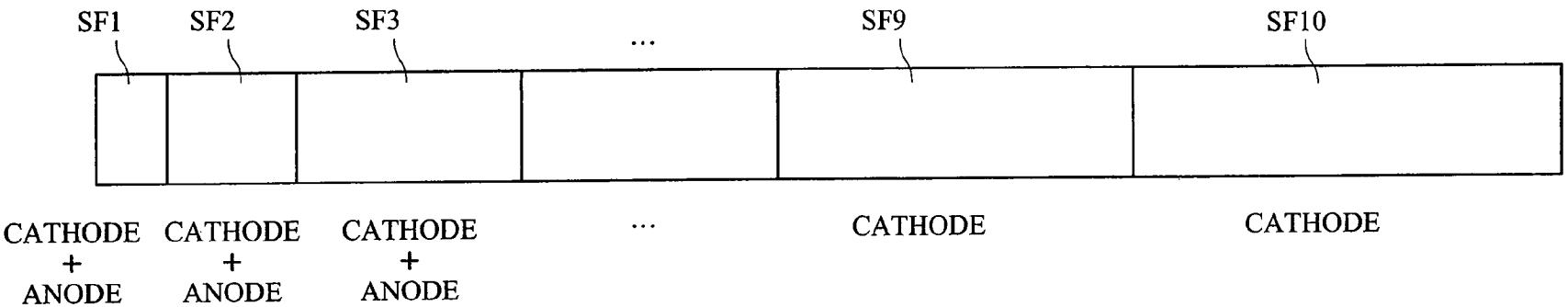
FIG. 6 is a diagram showing a sub-field structure of one field of the PDP device of the first embodiment.

Next, operations of the PDP device of the first embodiment will be described. In each cell of the PDP, only On/Off can be selected, and lighting luminance cannot be changed, i.e., grayscale display cannot be performed. Therefore, as shown in FIG. 6, one frame is divided into a plurality of predetermined weighted sub-fields SF1 to SF10, and grayscale display is performed for each cell by combining the lighting sub-fields in one frame. The numbers of sustain discharges are different in the sub-fields. Furthermore, in the sustain discharge periods of low-luminance sub-fields SF1, SF2, SF3, . . . , the Z electrodes operate as cathodes at the beginning and then operate as anodes from the middle of the period, and in the sustain discharge periods of high-luminance sub-fields . . . SF9 and SF10, the Z electrodes operate as cathodes all the time. Except for that, the sub-fields normally have the same driving sequence.

For example, when sustain discharges are generated eight times in a sub-field, the maximum number of times that the third electrode operates as a cathode is eight, and the maximum number of times that the third electrode operates as an anode is seven, wherein the ratio of the number of times that it operates as an anode to the number of times that it operates as a cathode ranges from 0:8 to 7:1. In other words, the ratio of the number of times that it operates as an anode to the number of times of sustain discharges is varied from 0/8 to 7/8. If the areas of the discharge electrodes of the X electrode, the Y electrode, and the Z electrode are the same as shown in FIG. 5 and the light emission amount of a cathode is about twice as large as that of an anode, the luminance ratio of the case where the third electrode operates as a cathode to the case where the third electrode operates as an anode is 5:4. Therefore, the ratio of the luminance at the time when the third electrode operates as a cathode eight times to the luminance at the time when the third electrode operates as an anode seven times (one time as a cathode) is 40:33. In other words, when the luminance at the time when the third electrode operates as a cathode eight times is defined as 1, the luminance can be reduced to about 83% at the time when the third electrode operates as an anode seven times, and the luminance can be adjusted by changing the number of times that it operates as an anode. The more the number of times of sustain discharges is in the sub-field, the larger the luminance reduction rate becomes.

Figure 7:
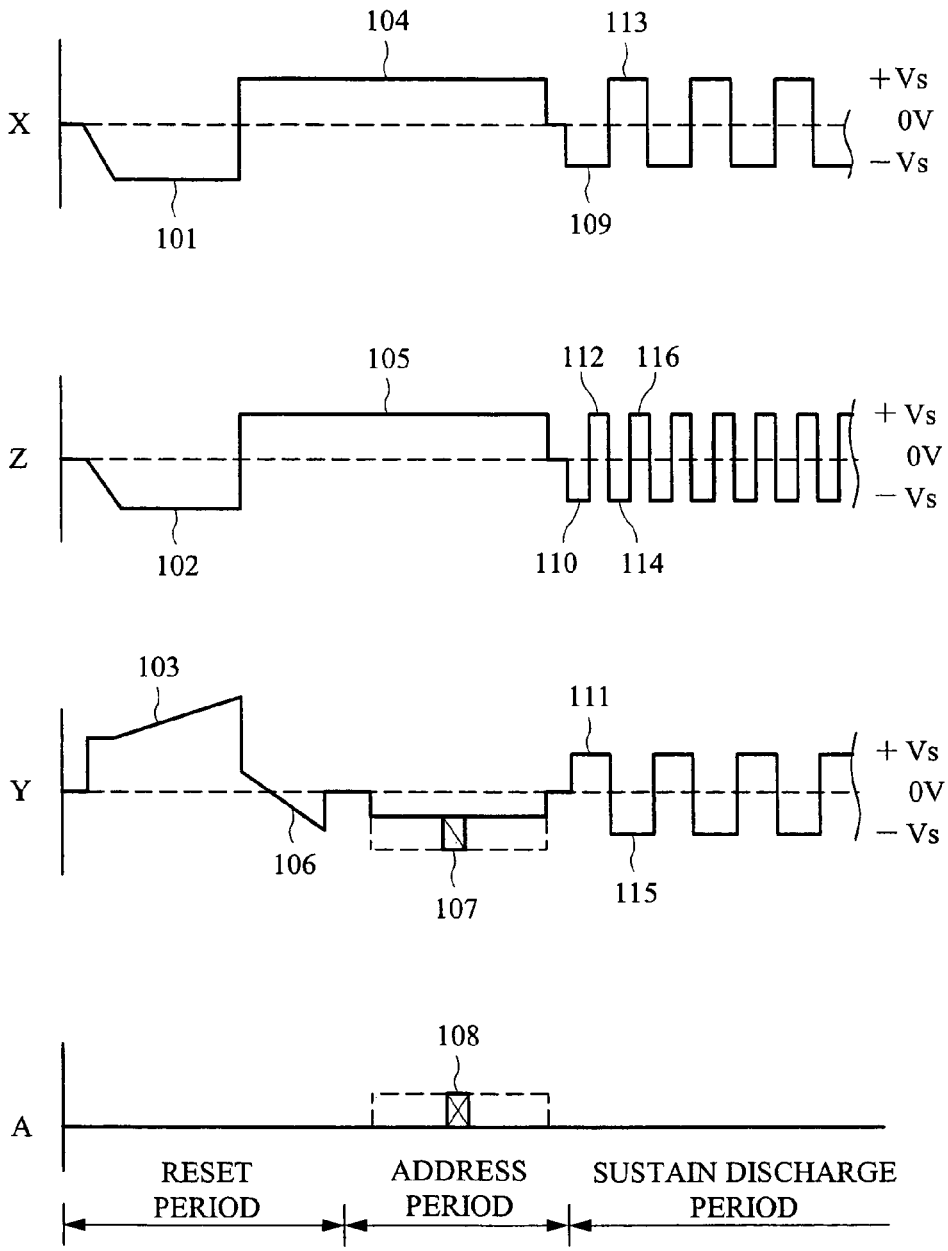
FIG. 7 is a diagram showing driving waveforms of the first embodiment.
Figure 8:
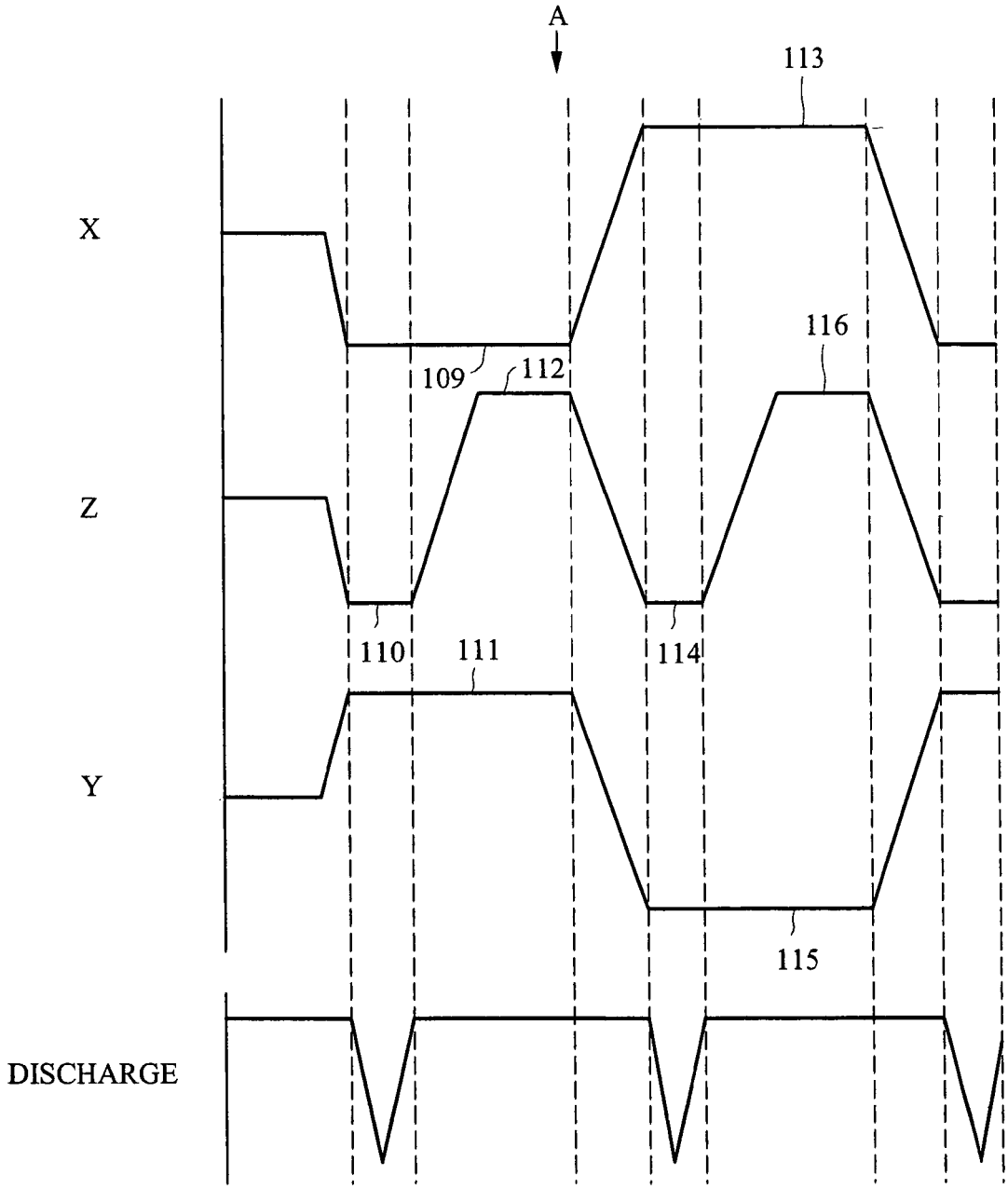
FIG. 8 is a diagram showing details of the driving waveforms in a sustain discharge period of the first embodiment.
Figure 9:
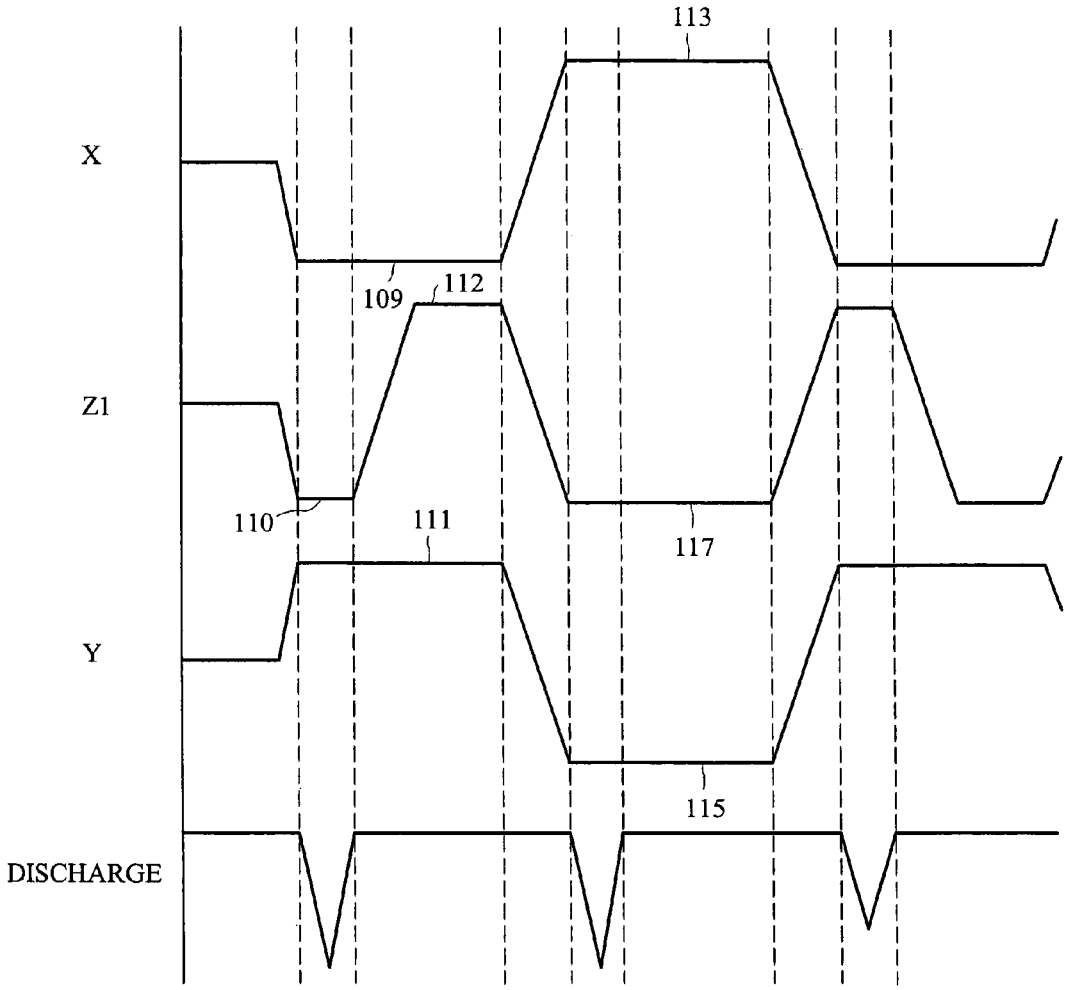
FIG. 9 is a diagram showing details of the driving waveforms in a sustain discharge period of the first embodiment.
Figure 10:
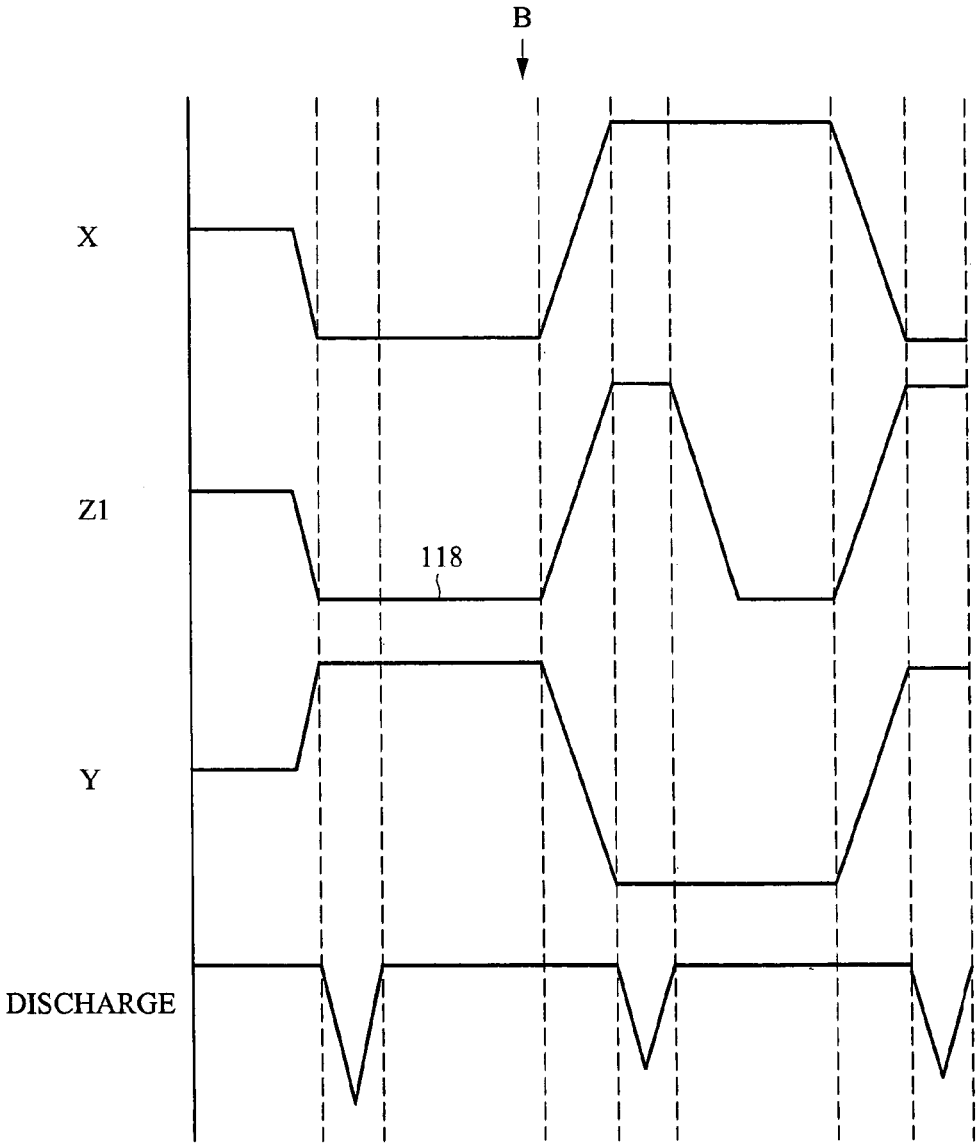
FIG. 10 is a diagram showing details of the driving waveforms in the sustain discharge period of the first embodiment.

FIG. 7 is a diagram showing driving waveforms of one sub-field of the PDP device of the first embodiment, which shows the driving waveforms in the case where the Z electrode operates as a cathode all the time in the sustain discharge period, for example, the high-luminance sub-fields SF9 and SF10 shown in FIG. 6. FIG. 8 is a diagram showing details of the driving waveforms in the sustain discharge period of this case. Also, FIG. 9 and FIG. 10 are diagrams showing details of the driving waveforms in the sustain discharge periods of the cases where the Z electrode is controlled to operate as a cathode at first and to operate as an anode from the middle of the period in the sustain discharge period, for example, the low-luminance sub-fields SF1, SF2, and SF3 shown in FIG. 6, wherein FIG. 9 shows the case where the Z electrode operates as an anode from the third sustain discharge, and FIG. 10 shows the case where the Z electrode operates as an anode from the second sustain discharge.

At the beginning of a reset period, in a state where 0 V is applied to address electrodes A, negative reset pulses 101 and 102 in which a potential is gradually lowered to reach a constant value are applied to the X electrodes and the Z electrodes, and a positive reset pulse 103 in which a predetermined potential is applied and then the potential gradually increases is applied to the Y electrodes. By doing so, in all the cells, discharges are generated between the Z discharge electrodes 16 and the Y discharge electrodes 14 at first, and the discharge is shifted to the discharges between the X discharge electrodes 12 and the Y discharge electrodes 14. Since the pulses applied here are obtuse waves in which the potentials are gradually changed, slight discharges and charge formation are repeated, and wall charge is formed uniformly in all of the cells. The polarity of the formed wall charge is the positive polarity in the vicinities of the X discharge electrodes and the Z discharge electrodes and is the negative polarity in the vicinity of the Y discharge electrodes.

Then, positive compensation potentials 104 and 10S (for example, +Vs) are applied to the X discharge electrodes and the Z discharge electrodes, and a compensation obtuse wave 106 in which the potential gradually decreases is applied to the Y electrodes. By doing so, since the voltage of the polarity opposite to that of the wall charge which has been formed in the above-described manner is applied in the obtuse wave, wall charge in the cells are reduced through slight discharges. In the above-described manner, the reset period is completed, and all of the cells are brought into a uniform state.

In the PDP of the present embodiment, since the distance between the Z discharge electrode 16 and the Y discharge electrode 14 is narrow, a discharge is caused even by a low firing voltage, which triggers a shift to the discharge between the X discharge electrode 12 and the Y discharge electrode 14. Therefore, the reset voltage applied between the X and Z electrodes and the Y electrode in the reset period can be reduced. Accordingly, the amount of light emitted through the reset discharges which are not involved in display can be reduced, thereby improving the contrast.

In a subsequent address period, the voltages (for example, +Vs) which is the same as the compensation potentials 104 and 105 are applied to the X electrodes and the Z electrodes, and a predetermined negative potential is applied to the Y electrodes. In this state, a scan pulse 107 is further sequentially applied to the Y electrodes. In accordance with the application of the scan pulse 107, an address pulse 108 is applied to the address electrodes of the cells to be turned on. Consequently, discharges are generated between the Y electrodes to which the scan pulse is applied and the address electrodes to which the address pulse is applied, and these discharges trigger the generation of discharges between the X and Z discharge electrodes and the Y discharge electrodes. Through these address discharges, negative wall charge is formed in the vicinities of the X electrodes and the Z electrodes (on the surface of the dielectric layer), and positive wall charge is formed in the vicinity of the Y electrodes. In this case, the positive wall charge formed in the vicinity of the Y electrode corresponds to the amount of the wall charge of the total negative wall charges formed in the vicinities of the X electrode and the Z electrode. In the cells to which the scan pulse or the address pulse is not applied, the wall charge at the time of the reset is maintained since the address discharge is not generated. In the address period, the scan pulse is sequentially applied to all of the Y electrodes to carry out the above-described operations, and address discharges are generated in all of the cells to be turned on in the entire panel surface.

Note that, at the end of the address period, in the cells in which the address discharges are not generated, a pulse for adjusting the wall charge which has been formed in the reset period is applied in some cases.

In the sustain discharge period, first, a negative sustain discharge pulse 109 of a potential −Vs is applied to the X electrodes, a negative pulse 110 of the potential −Vs is applied to the Z electrodes, and a positive sustain discharge pulse 111 of the potential +Vs is applied to the Y electrodes. In each of the cells in which the address discharge has been carried out, the voltage by the positive wall charge formed in the vicinity of the Y electrode is superimposed on the potential +Vs, and the voltage by the negative wall charge formed in the vicinities of the X electrode and the Z electrode is superimposed on the potential −Vs. Consequently, the voltage between the X and Z electrodes and the Y electrode exceeds the firing voltage, a discharge is first started between the Z discharge electrode and the Y discharge electrode where the distance therebetween is narrow, and the discharge triggers a shift to a discharge between the X electrode and the Y electrode where the distance therebetween is wide. The discharge between the X electrode and the Y electrode is a long-distance discharge, and is a discharge exhibiting good light emission efficiency.

Figure 11A:
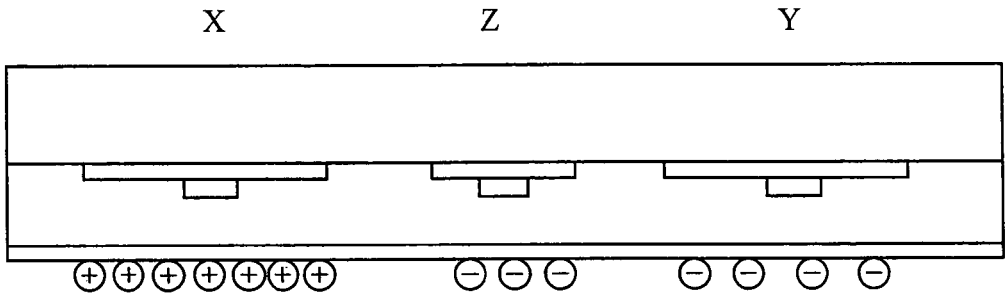
FIG. 11A is a diagram showing the state of wall charge formed in the sustain discharge period of the first embodiment.

As shown in FIG. 8, this discharge is generated when −Vs is applied to the X and Z electrodes and +Vs is applied to the Y electrode (in practice, generated slightly after the application of the potentials), the discharge intensity attains a peak value after a certain time, and then, the discharge intensity is attenuated. In the first embodiment, when the discharge intensity is sufficiently attenuated, a positive pulse 112 of the potential +Vs is applied to the Z electrode. The negative wall charge in the vicinities of the X electrode and the Z electrode and the positive wall charge in the vicinity of the Y electrode have been eliminated in the above-described discharge, and the positive charge and the negative charge generated by the discharge move to the vicinities of the X electrode and the Z electrode and to the vicinity of the Y electrode, respectively. However, sufficient wall charge has not been formed yet. Moreover, although the voltage by the charge in the vicinity of the Z electrode increases the potential of the Z electrode, the voltages by the charge in the vicinities of the X electrode and the Y electrode increase the potential of the X electrode and decrease the potential of the Y electrode. Therefore, even when the pulse 112 is applied, no discharge is generated between the X electrode and the Z electrode and between the Y electrode and the Z electrode. When the potential +Vs is applied to the Z electrode, the positive charge in the vicinity of the Z electrode is not accumulated on the dielectric layer immediately above the Z electrode, but inversely, negative charge moves onto the dielectric layer immediately above the Z electrode so as to form negative wall charge. FIG. 11A shows the state of the wall charge in the cell at this point (point denoted as A in FIG. 8). Positive wall charge is formed on the dielectric layer immediately above the X electrode, negative wall charge is formed on the dielectric layer immediately above the Y electrode, and negative wall charge is formed also on the dielectric layer immediately above the Z electrode.

The timing for applying the positive pulse 112 of the potential +Vs to the Z electrode is determined in the manner described below. Ultraviolet rays are generated by the discharge, the ultraviolet rays excite the phosphor to emit visible light, and the light is outputted to outside the panel through the glass substrate. The ultraviolet rays are not outputted to outside since they are absorbed into the glass substrate, and the ultraviolet rays cannot be detected outside the panel. Infrared light is also generated together with the ultraviolet rays by the discharge, and the generation timing of the ultraviolet rays and the infrared light is approximately the same. Therefore, the state variation of the discharge can be detected by measuring the infrared light. The intensity of the discharge of FIG. 8 is obtained by measuring the infrared light. In this case, the application of the pulse 112 is started at the point when the intensity of the infrared light exceeds the maximum intensity and is reduced to 10% of the peak value.

As described above, the negative wall charge is formed in the vicinities of the Y electrode and the Z electrode, and the positive wall charge is formed in the vicinity of the X electrode. Then, a pulse 113 of the potential +Vs is applied to the X electrode, a pulse 115 of the potential −Vs is applied to the Y electrode, and a pulse 114 of the potential −Vs is applied to the Z electrode. As a result, the voltage between the X electrode and the Y and Z electrodes is superimposed on the voltage by the wall charge, and exceeds the firing voltage. Consequently, first, a discharge is started between the Z discharge electrode and the X discharge electrode where the distance therebetween is narrow, and this discharge triggers a shift to a discharge between the X electrode and the Y electrode where the distance therebetween is wide. This discharge is a discharge in which the Z electrode operates as a cathode. Then, when the discharge intensity is sufficiently attenuated, a positive pulse 116 of the potential +Vs is applied to the Z electrode. Consequently, negative wall charge is formed in the vicinities of the X electrode and the Z electrode, and positive wall charge is formed in the vicinity of the Y electrode. After this, similarly, the sustain discharge pulses of alternately changed polarities are applied to the X electrode and the Y electrode, and the pulse of frequency that is twice the sustain discharge pulse is applied to the Z electrode. By doing so, the sustain discharges in which the Z electrode is operated as a cathode all the time are repeated.

Next, the case where the Z electrode operates as a cathode at the beginning of the sustain discharge period and the electrode operates as an anode from the middle of the period like in SF1, SF2, and SF3 shown in FIG. 6 will be described with reference to FIG. 9 and FIG. 10.

As shown in FIG. 9, the operation until the second sustain discharge is the same as that of FIG. 8. In the example of FIG. 8, in order to generate the second sustain discharge, the negative pulse 114 of −Vs is applied to the Z electrode and the positive pulse 116 of +Vs is applied to the Z electrode immediately after the sustain discharge is completed. On the other hand, in the example of FIG. 9, a negative pulse 117 of −Vs is applied to the Z electrode and the potential is retained also after the discharge is completed. Consequently, negative wall charge is accumulated in the vicinity of the X electrode, and positive wall charge is accumulated in the vicinities of the Y electrode and the Z electrode. Then, when a negative potential of −Vs is applied to the X electrode and a positive potential of +Vs is applied to the Y electrode and the Z electrode, the discharge is generated between the Y and Z electrodes and the X electrode. At this time, the Z electrode operates as an anode.

After this discharge, although the negative potential of −Vs and the positive potential of +Vs are continuously applied to the X electrode and the Y electrode, respectively, the negative potential of −Vs is applied to the Z electrode. Consequently, positive wall charge is accumulated in the vicinities of the X electrode and the Z electrode, and negative wall charge is accumulated in the vicinity of the Y electrode. Then, when the positive potential of +Vs is applied to the X electrode and the Z electrode and the negative potential of −Vs is applied to the Y electrode, the discharge is generated between the X and Z electrodes and the Y electrode. At this time, the Z electrode operates as an anode. After this, when the potential applied to the Z electrode is changed at the half cycle of the cycle for changing the potentials applied to the X electrode and the Y electrode, the sustain discharges in which the Z electrode operates as an anode are repeated.

Figure 11B:
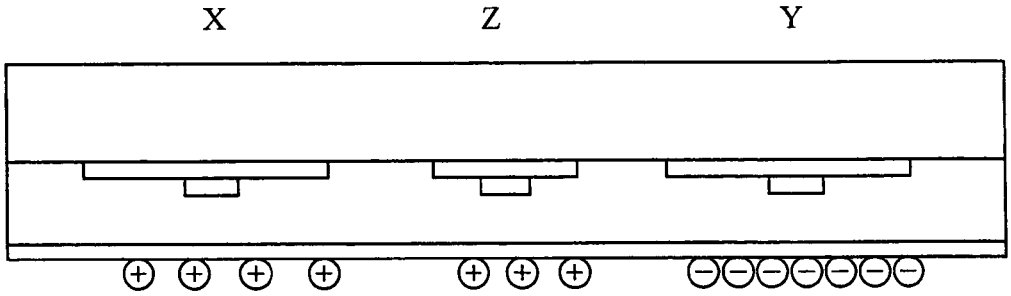
FIG. 11B is a diagram showing the state of wall charge formed in the sustain discharge period of the first embodiment.

In the example of FIG. 10, the operation of the first sustain discharge is the same as that of FIG. 8. In the example of FIG. 8, the positive pulse 112 of +Vs is applied to the Z electrode immediately after the first sustain discharge is completed. On the other hand, in the example of FIG. 10, a negative pulse 118 of −Vs is applied to the Z electrode, and the potential is retained also after the discharge is completed. Consequently, negative wall charge is accumulated in the vicinity of the X electrode, and positive wall charge is accumulated in the vicinities of the Y electrode and the Z electrode. FIG. 11B shows the state at this point (point denoted as B in FIG. 10). Then, when the positive potential of +Vs is applied to the X electrode and the Z electrode and the negative potential of −Vs is applied to the Y electrode, the discharge is generated between the X and Z electrodes and the Y electrode. At this time, the Z electrode operates as an anode.

After this discharge, although the positive potential of +Vs and the negative potential of −Vs are continuously applied to the X electrode and the Y electrode, respectively, the negative potential of −Vs is applied to the Z electrode. Consequently, positive wall charge is accumulated in the vicinities of the Y electrode and the Z electrode, and negative wall charge is accumulated in the vicinity of the X electrode. Then, when the positive potential of +Vs is applied to the Y electrode and the Z electrode, and the negative potential of −Vs is applied to the X electrode, the discharge is generated between the Y and Z electrodes and the X electrode. At this time, the Z electrode operates as an anode. After this, when the potential applied to the Z electrode is changed at the half-cycle of the cycle for changing the potentials applied to the X electrode and the Y electrode, the sustain discharges in which the Z electrode operates as an anode are repeated.

A shown in FIG. 8 to FIG. 10, when the potential of the Z electrode is to be changed in order to generate a discharge, it is desired to reduce the load capacitance by changing the potential of the Z electrode at the same time as the potential change of the X electrode and/or the Y electrode.

In FIG. 8, although the negative sustain discharge pulses 110 and 114 applied to the Z electrode have the same width, the width may be narrowed from, for example, the third pulse. The sustain discharges are repeatedly performed, and the wall charge formed through the address discharge is utilized for performing the first sustain discharge. However, since the wall charge formed through the address discharge is small and the floating charge in the discharge space is also small, even when the first sustain discharge pulses (including the pulse to the Z electrode) are applied, generation of a discharge is delayed, and completion of the discharge is correspondingly delayed. On the other hand, when the sustain discharges are repeated for several times, since wall charge larger than the wall charge formed through the address discharge is formed and the floating charge in the discharge space is also increased, the delay of the generation of a discharge from application of the sustain discharge pulses and the time until discharge completion are shortened. Therefore, at the beginning of sustain discharges (first and second discharges), the time in which the negative potential −Vs is applied to the Z electrode is extended, and the time is shortened thereafter. In other words, the period in which the Z electrode operates as a cathode is extended at the beginning of the repeated discharges, and is shortened thereafter. Consequently, a sufficient amount of wall charge can be formed in the vicinity of the Z electrode, and stable sustain discharges can be performed. This principle is true of the case where the sustain discharges are repeated while operating the Z electrode as an anode after operating it as a cathode, and the time for applying the positive potential +Vs to the Z electrode is extended after performing several times of sustain discharges.

In the first embodiment, in the reset period and the address period, the same potential is applied to the X electrode and the Z electrode. It is also possible to apply the same potential as that of the Y electrode to the Z electrode in the reset period and the address period. However, since the Y electrode also serves as a scanning electrode, a scan driver for driving the Z electrode is needed to set the Z electrode to the same potential as the Y electrode during a scanning period, which causes a problem of cost increase. Therefore, during the scanning period, the Z electrode is desired to be set to the same potential as the X electrode, and the Z electrode also operates as a cathode as well as the X electrode at the beginning of the sustain discharge period due to the wall charge accumulated by the address discharge.

The first embodiment of the present invention has been described above. However, various modification examples can be provided for the structures and the shapes of the electrodes. Hereinafter, modification examples will be described.

Figure 12:
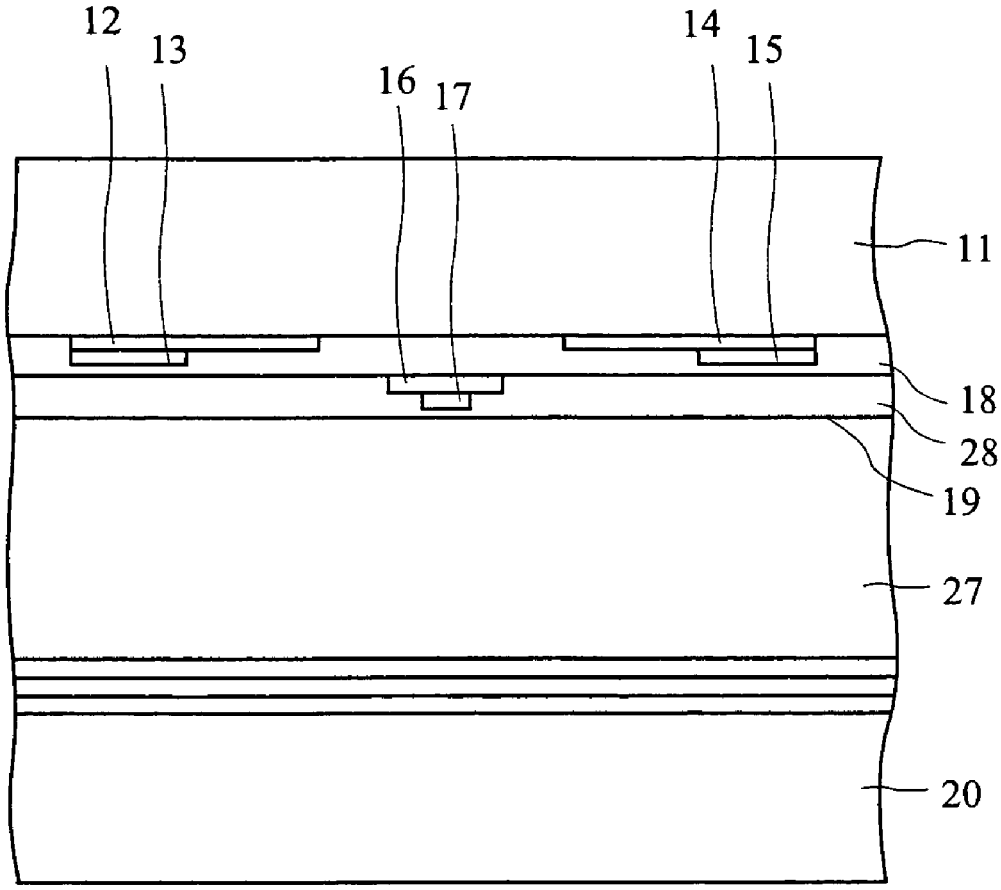
FIG. 12 is a diagram showing a modification example of the electrode structure.

FIG. 12 is a diagram showing a modification example of the electrode structures. In the first embodiment, as shown in FIG. 4A, the Z electrode (Z discharge electrode 16 and Z bus electrode 17) is formed in the same layer as the X electrode (X discharge electrode 12 and X bus electrode 13) and the Y electrode (Y discharge electrode 14 and Y bus electrode 15). In such a case, the Z electrode can be formed in the same process as the X electrode and the Y electrode, and new processes for providing the Z electrodes are not required to be added. However, since the Z electrode is provided between the X discharge electrode 12 and the Y discharge electrode 14, there is a problem that, due to variations in the positions and line widths in fabrication, the Z electrode is short-circuited with the X discharge electrode 12 and the Y discharge electrode 14 and the yield is lowered. Therefore, in the modification example of FIG. 12, the Z electrode (Z discharge electrode 16 and Z bus electrode 17) is formed on the dielectric layer 18 covering the X electrode (X discharge electrode 12 and X bus electrode 13) and the Y electrode (Y discharge electrode 14 and Y bus electrode 15), and the dielectric layer and the Z electrode are covered with a dielectric layer 28. Also in this structure, the same operation as the first embodiment can be carried out.

Although the modification example of FIG. 12 has a problem that the manufacturing cost is increased in comparison with the first embodiment since the process for providing the Z electrode is added. However, the Z electrode is not short-circuited with the X discharge electrode 12 and the Y discharge electrode 14 since the Z electrode is formed in the layer different from that of the X electrode and the Y electrode, and reduction in yield due to short circuit can be prevented. Moreover, since they are provided in different layers, when viewed from above the substrate, the distances between the Z electrode and the X discharge electrode 12 and between the Z electrode and the Y discharge electrode 14 can be significantly reduced, and it is possible to set the distance capable of achieving the approximately Paschen minimum.

Also, as shown in FIG. 7, the X discharge electrode 12 and the Y discharge electrode 14 have a T-shape in each cell, and they are independent from the discharge electrodes of adjacent cells. However, it is also possible to use a conventional electrode shape in which the X and Y discharge electrodes are provided in parallel to the X and Y bus electrodes and electrodes which connect the X and Y bus electrodes to the X and Y discharge electrodes are provided in the part of the barrier ribs.

Second Embodiment

Figure 13:
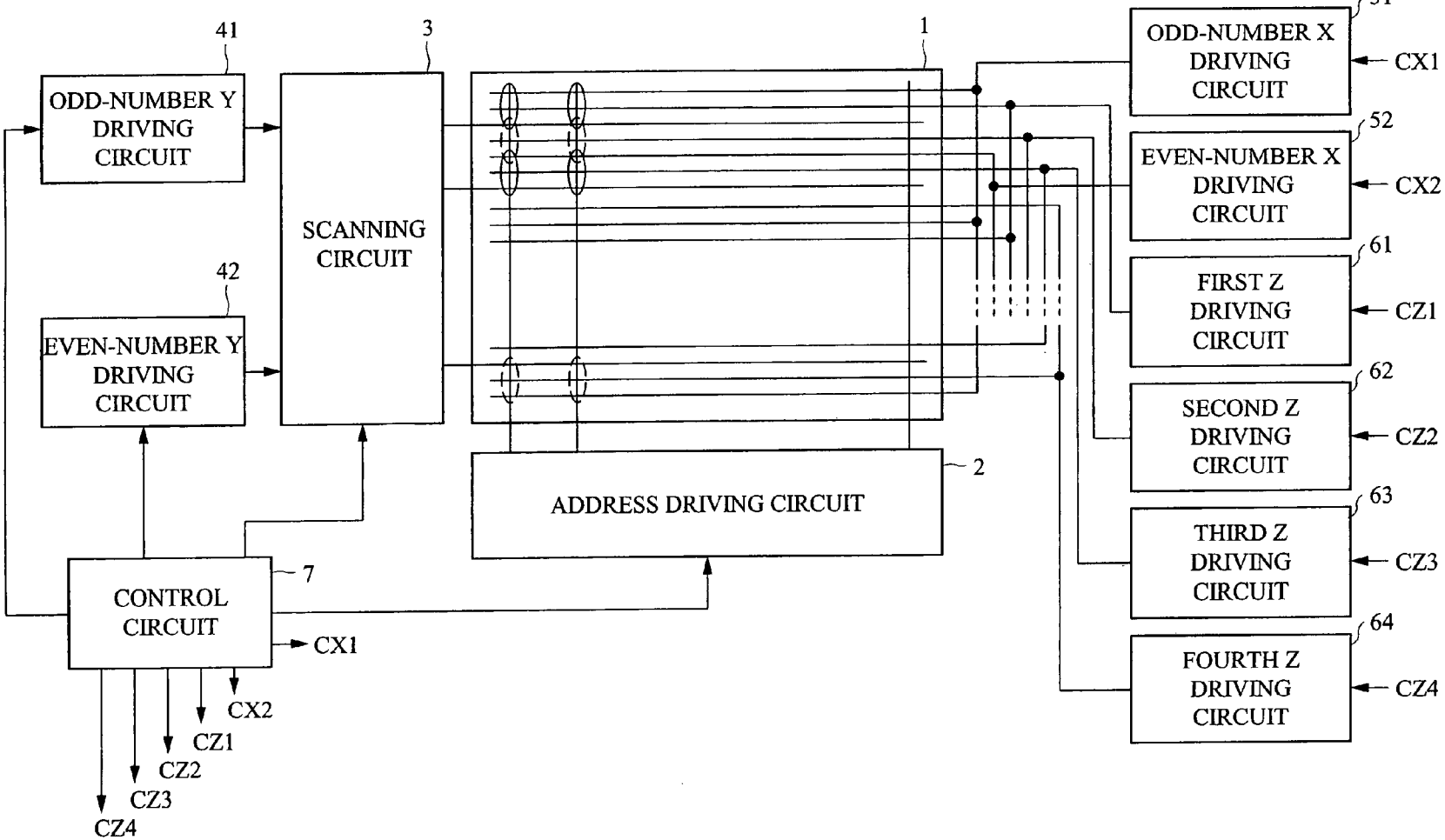
FIG. 13 is a diagram showing the entire structure of a PDP device of a second embodiment of the present invention.

FIG. 13 is a diagram showing the entire structure of a PDP device of the second embodiment of the present invention. The second embodiment is an example in which the present invention is applied to an ALIS PDP device disclosed in Patent Document 5. In this example, in the structure including the first and second electrodes (X and Y electrodes) provided in a first substrate (transparent substrate) and the address electrodes provided in a second electrode (rear substrate), the third (Z electrode) is provided between the X electrode and the Y electrode. Since the ALIS method is disclosed in Patent Document 5, detailed description thereof will be omitted here.

As shown in FIG. 13, the plasma display panel 1 has a plurality of laterally (longitudinally) extending first electrodes (X electrodes) and second electrodes (Y electrodes). The plurality of X electrodes and Y electrodes are alternately disposed, and the number of the lines of the X electrodes is larger than that of the Y electrodes by one. The third electrode (Z electrode) is disposed between the X electrode and the Y electrode. Therefore, the number of the lines of the Z electrodes is twice that of the Y electrodes. The address electrodes are extending in the direction perpendicular to the extending direction of the X, Y, and Z electrodes. In the ALIS method, all of the spaces between the X electrodes and the Y electrodes are utilized as display lines, and odd-number display lines and even-number display lines are subjected to interlaced display. In other words, the odd-number display lines are formed between the odd-numbered X electrodes and the odd-numbered Y electrodes and between the even-numbered X electrodes and even-numbered Y electrodes, and the even-number display lines are formed between the odd-numbered Y electrodes and the even-numbered X electrodes and between the even-numbered Y electrodes and the odd-numbered X electrodes. One display field is comprised of an odd-number field and an even-number field, wherein the odd-number display lines are displayed in the odd-number field, and the even-number display lines are displayed in the even-number field. Therefore, the Z electrodes are present in each of the odd-numbered and even-number display lines. In this case, the Z electrodes provided between the odd-numbered X electrodes and the odd-numbered Y electrodes are referred to as the Z electrodes of a first group, the Z electrodes provided between the odd-numbered Y electrodes and the even-numbered X electrodes are referred to as the Z electrodes of a second group, the Z electrodes provided between the even-numbered X electrodes and the even-numbered Y electrodes are referred to as the Z electrodes of a third group, and the Z electrodes provided between the even-numbered Y electrodes and the odd-numbered X electrodes are referred to as the Z electrodes of a fourth group. In other words, the 4p+1th (wherein p is a natural number) Z electrode is the Z electrode of the first group, the 4p+2th Z electrode is the Z electrode of the second group, the 4p+3th Z electrode is the Z electrode of the third group, and the 4p+4th Z electrode is the Z electrode of the fourth group.

As shown in FIG. 13, the PDP device of the second embodiment has the address driving circuit 2 which drives the address electrodes, the scanning circuit 3 which applies scan pulses to the Y electrodes, an odd-number Y driving circuit 41 which applies voltages other than the scan pulse to the odd-numbered Y electrodes in common via the scanning circuit 3, an even-number Y driving circuit 42 which applies voltages other than the scan pulse to the even-numbered Y electrodes in common via the scanning circuit 3, an odd-number X driving circuit 51 which applies voltages to the odd-numbered X electrodes in common, an even-number X driving circuit 52 which applies voltages to the even-numbered X electrodes in common, a first Z driving circuit 61 which drives the Z electrodes of the first group in common, a second Z driving circuit 62 which drives the Z electrodes of the second group in common, a third Z driving circuit 63 which drives the Z electrodes of the third group in common, a fourth Z driving circuit 64 which drives the Z electrodes of the fourth group in common, and the control circuit 7 which controls each of the circuits.

The PDP of the second embodiment has the same structure as the first embodiment except that the X discharge electrodes and the Y discharge electrodes are provided on both sides of the X bus electrodes and the Y bus electrodes, respectively, and the Z electrodes are provided between all of the X bus electrodes and the Y bus electrodes. Therefore, the exploded perspective view thereof will be omitted. Note that the Z electrodes can be formed in the same layer as the X and Y electrodes as shown in FIG. 4 or can be formed in the layer different from that of the X and Y electrodes as shown in FIG. 12.

Figure 14:
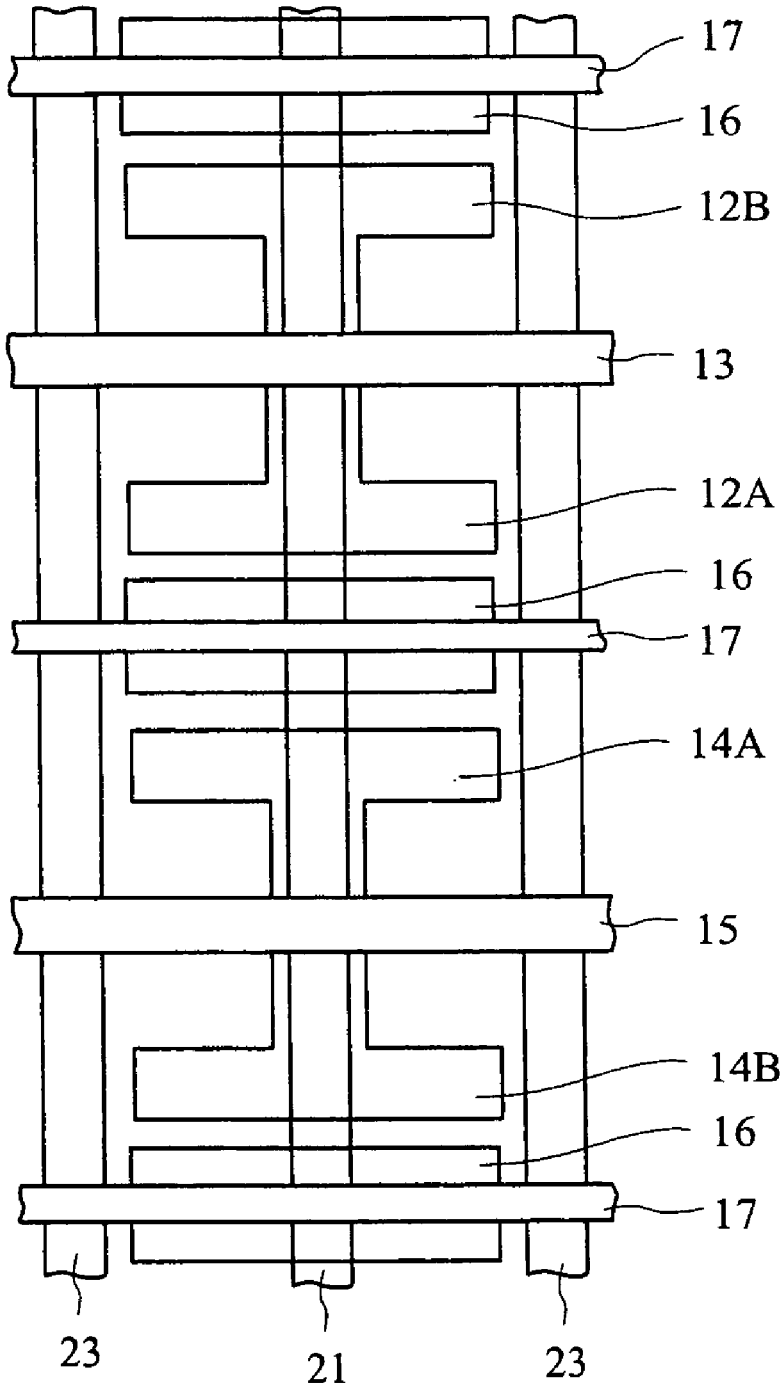
FIG. 14 is a diagram showing the shapes of the electrodes of the second embodiment.

FIG. 14 is a diagram showing the electrode shapes of the second embodiment. As shown in the diagram, the equally-spaced X bus electrode 13 and the Y bus electrode 15 are disposed in parallel to each other, and the Z electrode 16, 17 is disposed in parallel to them at the center between them. In addition, the barrier ribs 23 extending in the direction perpendicular to the bus electrodes 13, 15, and 17 are disposed. The address electrode 21 is disposed between the barrier ribs 23. In each section divided by the barrier ribs 23, an X discharge electrode 12A which is downwardly extending from the X bus electrode 13, an X discharge electrode 12B which is upwardly extending from the X bus electrode 13, a Y discharge electrode 14A which is upwardly extending from the Y bus electrode 15, a Y discharge electrode 14B which is downwardly extending from the Y bus electrode 15, and a Z discharge electrode 16 which is upwardly and downwardly extending from the Z bus electrode 17 are provided. The opposing edges of the X discharge electrodes 12A and 12B and the Z discharge electrode 16 and the opposing edges of the Y discharge electrodes 14A and 14B and the Z discharge electrode 16 are parallel to the extending direction of the X bus electrodes 13, the Y bus electrode 15, and the Z bus electrode 17.

Figure 15:
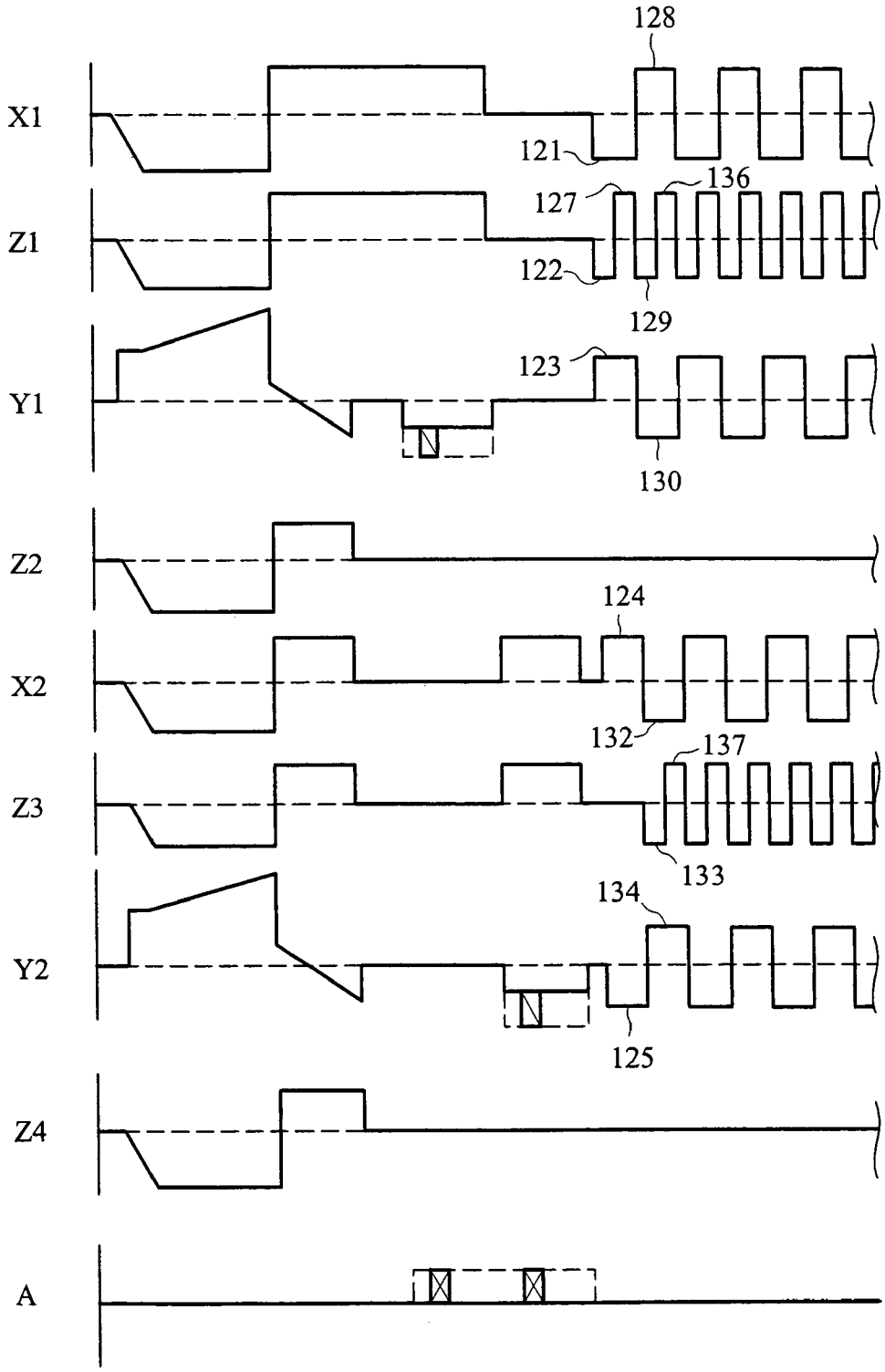
FIG. 15 is a diagram showing driving waveforms (odd-number field) of the second embodiment.
Figure 16:
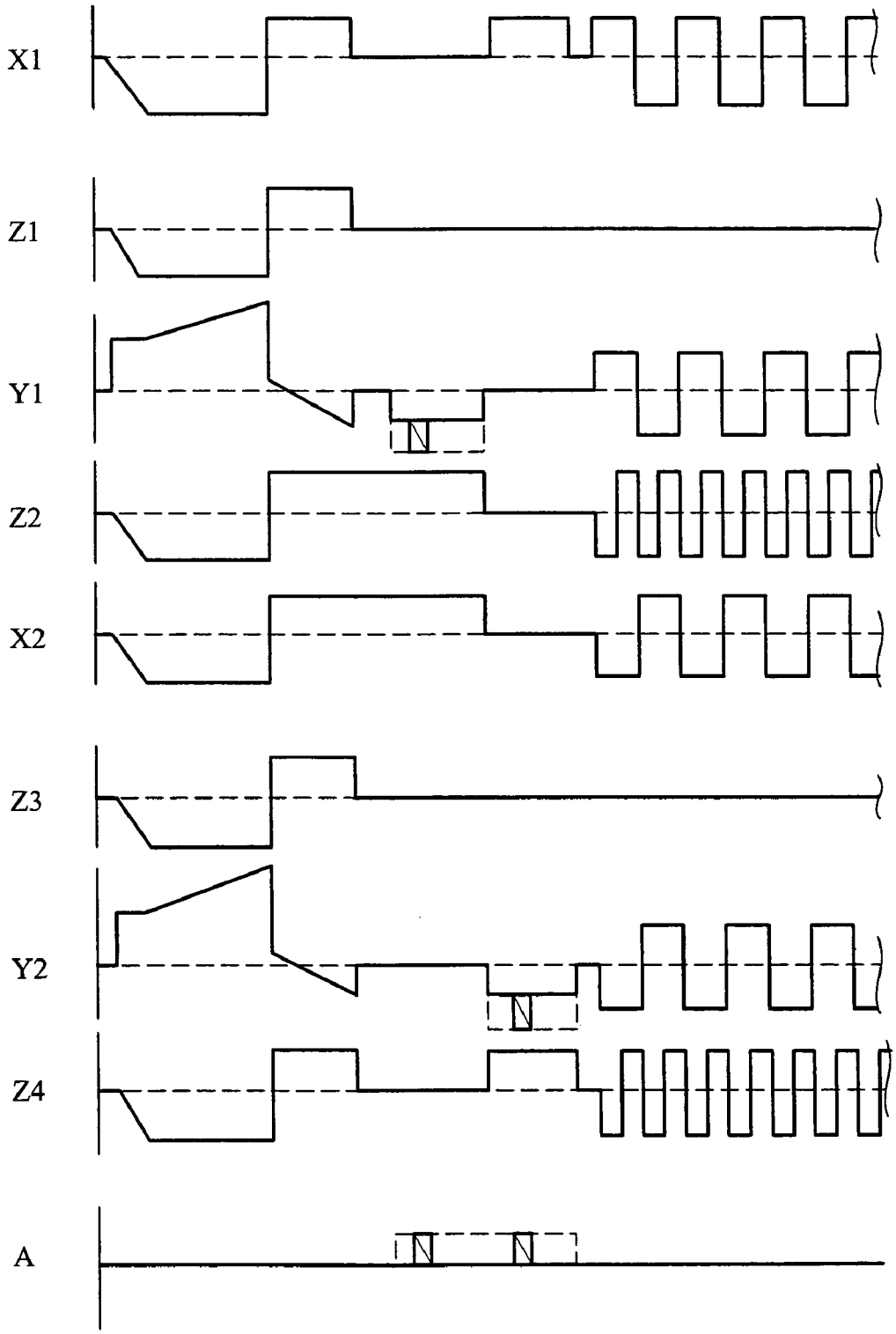
FIG. 16 is a diagram showing driving waveforms (even-number field) of the second embodiment.

FIG. 15 and FIG. 16 are diagrams showing driving waveforms of the PDP device of the second embodiment, wherein FIG. 15 shows the driving waveforms of the odd-number field and FIG. 16 shows the driving waveforms of the even-number field. FIG. 15 and FIG. 16 show the driving waveforms of the case where the Z electrode operates as a cathode all the time in the sustain discharge period like in the first embodiment shown in FIG. 6A. If the Z electrode is controlled to operate as a cathode at the beginning and to operate as an anode from the middle of the period in the sustain discharge period, the driving waveforms of, for example, FIG. 9 and FIG. 10 are applied. The driving waveforms applied to the X electrodes, the Y electrodes, and the address electrodes are the same as those disclosed in Patent Document 5, driving waveforms similar to the waveforms shown in FIG. 7 to FIG. 10 are applied to the Z electrode which is provided between the X electrode and the Y electrode where a discharge is to be performed, and an intermediate potential between +Vs and −Vs (in this case, 0 V) is applied to the Z electrode which is provided between the X electrode and the Y electrode where no discharge is to be performed.

The driving waveforms in the reset period are the same as the driving waveforms of the first embodiment, and all of the cells are brought into a uniform state in the reset period.

In the first half of the address period, a predetermined potential (for example, +Vs) is applied to the odd-numbered X electrode X1 and the Z electrode Z1 of the first group, the even-numbered X electrode X2, the even numbered Y electrode Y2, and the Z electrodes Z2 to Z4 of the second to fourth groups are set to be at 0 V, and a predetermined negative potential is applied to the odd-numbered Y electrode Y1. In this state, a scan pulse is further applied sequentially. In accordance with the application of the scan pulse, the address pulse is applied to the address electrode of the cell to be turned on. Consequently, a discharge is generated between the odd-numbered Y electrode Y1 to which the scan pulse has been applied and the address electrode to which the address pulse has been applied, and this discharge triggers the generation of a discharge between the odd-numbered X electrode X1 and the odd-numbered Y electrode Y1 and between the Z electrode Z1 of the first group and the odd-numbered Y electrode Y1. Through this address discharge, negative wall charge is formed in the vicinities of the odd-numbered X electrode X1 and the Z electrode Z1 of the first group (on the surface of the dielectric layer), and positive wall charge is formed in the vicinity of the odd-numbered Y electrode Y1. In the cell to which the address pulse or the scan pulse is not applied, the wall charge at the time of the reset is maintained since the address discharge is not generated. In the first half of the address period, the scan pulse is applied sequentially to all of the odd-numbered Y electrodes Y1 so as to perform the above-described operations.

In the latter half of the address period, the predetermined potential is applied to the even-numbered X electrode X2 and the Z electrode Z3 of the third group, the odd-numbered X electrode X1, the odd-numbered Y electrode Y1, and the Z electrodes Z1, Z2, and Z4 of the first, second and fourth groups are set to be at 0 V, and the predetermined negative potential is applied to the even-numbered Y electrode Y1. In this state, a scan pulse is further applied sequentially. In accordance with the application of the scan pulse, the address pulse is applied to the address electrode of the cell which is to be turned on. Consequently, a discharge is generated between the even-numbered Y electrode Y2 to which the scan pulse has been applied and the address electrode to which the address pulse has been applied, and this discharge triggers the generation of a discharge between the even-numbered X electrode X2 and the even-numbered Y electrode Y2 and between the Z electrode Z3 of the third group and the even-numbered Y electrode Y2. Through this address discharge, negative wall charge is formed in the vicinities of the even-numbered X electrode X2 and the Z electrode Z3 of the third group, and positive wall charge is formed in the vicinity of the even-numbered Y electrode Y2. In the latter half of the address period, the scan pulse is applied sequentially to all of the even-numbered Y electrodes Y2 so as to perform the above-described operations.

The address operations between the odd-numbered X electrodes X1 and the odd-numbered Y electrodes Y1 and between the even-numbered X electrodes X2 and the even-numbered, Y electrodes Y2, i.e., the address operations on the odd-number display lines are completed in the above-described manner. In the cells in which the address discharge has been performed, positive wall charge is formed in the vicinities of the odd-numbered and even-numbered Y electrodes Y1 and Y2, and negative wall charge is formed in the vicinities of the odd-numbered and even-numbered X electrodes X1 and X2 and the Z electrodes Z1 and Z3 of the first and third groups.

In the sustain discharge period, first, negative sustain discharge pulses 121 and 125 of the potential −Vs are applied to the odd-numbered X electrode X1 and the even-numbered Y electrode Y2, positive sustain discharge pulses 123 and 124 of the potential +Vs are applied to the odd-numbered Y electrode Y1 and the even-numbered X electrode X2, a negative pulse 122 of the potential −Vs is applied to the Z electrode Z1 of the first group, and 0 V is applied to the Z electrodes Z2 to Z4 of the second to fourth groups. In the odd-numbered X electrode X1 and the Z electrode Z1 of the first group, the voltages by the negative wall charge are superimposed on the potential −Vs, and the voltage by the positive wall charge is superimposed on the potential +Vs in the odd-numbered Y electrode Y1. As a result, a large voltage is applied therebetween. Consequently, first, a discharge is started between the Z electrode Z1 of the first group and the odd-numbered Y electrode Y1 in which the distance therebetween is narrow, and this discharge triggers a shift to a discharge between the odd-numbered X electrode X1 and the odd-numbered Y electrode Y1 in which the distance therebetween is wide. When this discharge is completed, a positive pulse 127 of the potential +Vs is applied to the Z electrode Z1 of the first group. At this point, positive wall charge is formed in the vicinity of the odd-numbered X electrode X1, and negative wall charge is formed in the vicinities of the odd-numbered Y electrode Y1 and the Z electrode Z1 of the first group.

At this point, in the even-numbered X electrode X2, the Z electrode Z3 of the third group, and the even-numbered Y electrode Y2, no discharge is generated since the accumulated wall charge has opposite polarities, and the wall charge is retained. Note that, instead of applying the pulses 124 and 125, 0 V may be applied to X2 and Y2.

Moreover, since +Vs is applied to the odd-numbered Y electrode Y1 and the even-numbered X electrode X2 and −Vs is applied to the even-numbered Y electrode Y2 and the odd-numbered X electrode X1, no discharge is generated therebetween. The potential +Vs is applied to the odd-numbered Y electrode Y1, and 0 V is applied to the Z electrode Z2 of the second group. Therefore, the voltage by the positive wall charge is superimposed in the odd-numbered Y electrode Y1, and the voltage between the odd-numbered Y electrode Y1 and the Z electrode Z2 of the second group increases. However, since the voltage applied to the Z electrode Z2 of the second group is 0 V and no wall charge has been formed in the Z electrode Z2 of the second group, the voltage by wall charge is not superimposed, and no discharge is generated. Conversely, the voltage applied to the Z electrode Z2 of the second group has to be set to the voltage that does not cause a discharge. However, the voltage applied to the Z electrode Z2 of the second group is desired to be lower than the voltage +Vs applied to the adjacent odd-numbered Y electrode Y1 and even-numbered X electrode X2. This is for the following reason. When a sustain discharge is generated between the odd-numbered X electrode X1 and the odd-numbered Y electrode Y1, mobile electrons move from the odd-numbered X electrode X1 to the odd-numbered Y electrode Y1. However, if the voltage of the Z electrode Z2 of the second group is the same as the voltage of the odd-numbered Y electrode Y1, the electrons directly move to the Z electrode Z2 of the second group, and then reach the even-numbered X electrode X2. In such a case, when the sustain discharge pulse of the opposite polarity is then applied, an erroneous discharge is generated, and a display error occurs. On the other hand, when the voltage of the Z electrode Z2 of the second group is set to be lower than the voltage of the odd-numbered Y electrode Y1 like the present embodiment, the movement of the electrons can be prevented, and the occurrence of erroneous discharges between adjacent display lines can be prevented.

Then, positive sustain discharge pulses 128 and 134 of the potential +Vs are applied to the odd-numbered X electrode X1 and the even-numbered Y electrode Y2, negative sustain discharge pulses 130 and 132 of the potential −Vs are applied to the odd-numbered Y electrode Y1 and the even-numbered X electrode X2, negative pulses 129 and 133 of the potential −Vs are applied to the Z electrodes Z1 and Z3 of the first and third groups, and 0 V is applied to the Z electrode Z2 of the second group and the Z electrode Z4 of the fourth group. In the odd-numbered X electrode X1 and the Z electrode Z1 of the first group, as described above, positive wall charge has been formed through the previous sustain discharge, and the resulting voltage is superimposed on the potential +Vs, and in the odd-numbered Y electrode Y1, the voltage by the negative wall charge accumulated thorough the previous sustain discharge is superimposed on the potential −Vs. As a result, a large voltage is applied therebetween. Furthermore, in the even-numbered X electrode X2 and the Z electrode Z3 of the third group, the negative wall charge at the time when the addressing is completed has been retained, the resulting voltage is superimposed on the potential −Vs, and in the even-numbered Y electrode Y2, the positive wall charge at the time when addressing is completed has been retained, and the resulting voltage is superimposed on the potential +Vs. As a result, a large voltage is applied therebetween. Consequently, discharges are started between the Z electrode Z1 of the first group and the odd-numbered Y electrode Y1 and between the Z electrode Z3 of the third group and the even-numbered Y electrode Y2 in which the distances therebetween are narrow, and these discharges trigger the shifts to discharges between the odd-numbered X electrode X1 and the odd-numbered Y electrode Y1 and between the even-numbered X electrode X2 and the even-numbered Y electrode Y2 in which the distances therebetween are wide. When these discharges are completed, similar to the first embodiment, positive pulses 136 and 137 of the potential +Vs are applied to the Z electrode Z1 and Z3 of the first and third groups. Consequently, positive wall charge is formed in the vicinities of the odd-numbered X electrode X1, the Z electrode Z1 of the first group, the even-numbered X electrode X2, and the Z electrode Z3 of the third group, and negative wall charge is formed in the vicinities of the odd-numbered Y electrode Y1 and the even-numbered Y electrode Y2.

At this point, the same voltage −Vs is applied to the odd-numbered Y electrode Y1 and the even-numbered X electrode X2, and the same voltage +Vs is applied between the even-numbered Y electrode Y2 and the odd-numbered X electrode X1. Therefore, no discharge is generated therebetween. Also, though the voltage Vs is applied between the even-numbered Y electrode Y2 and the Z electrode Z4 of the fourth group, no discharge is generated therebetween as described above, and movement of the electrons generated in the adjacent cells is prevented, and the occurrence of erroneous discharges is prevented.

After that, the sustain discharge pulses are repeatedly applied while inverting the polarities thereof and the pulses are applied to each of the Z electrodes. By doing so, the sustain discharges are repeated.

As described above, the first sustain discharge is generated only between the odd-numbered X electrode X1 and the odd-numbered Y electrode Y1, and it is not generated between the even-numbered X electrode X2 and the even-numbered Y electrode Y2. Therefore, it is controlled so that a sustain discharge is generated only between the even-numbered X electrode X2 and the even-numbered Y electrode Y2, and no discharge is generated between the odd-numbered X electrode X1 and the odd-numbered Y electrode Y1 at the end of the sustain discharge period. By doing so, the numbers of times of the sustain discharges are made equal to each other.

In the foregoing, the driving waveforms of the odd-number field have been described. In the driving waveforms of the even-number field, the same driving waveforms as those in the odd-number field are applied to the odd-numbered and even-numbered Y electrodes Y1 and Y2, the driving waveform applied to the even-numbered X electrode X2 of the odd-number field is applied to the odd-numbered X electrode X1, the driving waveform applied to the odd-numbered X electrode X1 of the odd-number field is applied to the even-numbered X electrode X2, the waveform applied to the Z electrode Z2 of the second group of the odd-number field is applied to the Z electrode Z1 of the first group, the driving waveform applied to the Z electrode Z1 of the first group of the odd-number field is applied to the Z electrode Z2 of the second group, the driving waveform applied to the Z electrode Z4 of the fourth group of the odd-number field is applied to the Z electrode Z3 of the third group, and the driving waveform applied to the Z electrode Z3 of the third group of the odd-number field is applied to the Z electrode Z4 of the fourth group.

Figure 17:
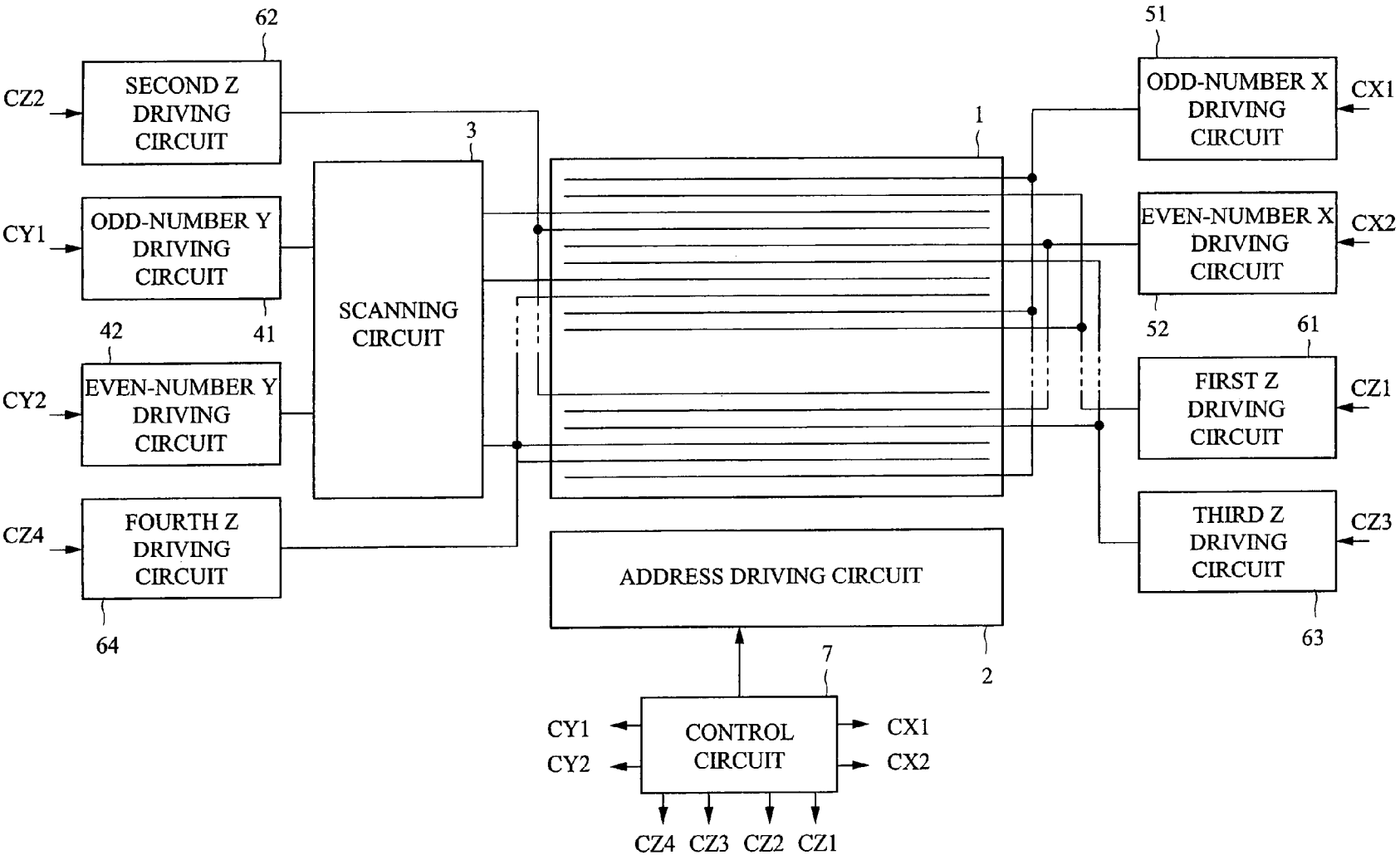
FIG. 17 is a diagram showing the entire structure of the PDP device of a modification example of the second embodiment.

FIG. 17 is a diagram showing the entire structure of a PDP device of a modification example of the second embodiment. This modification example is different from the second embodiment in that the Z electrodes Z1 and Z3 of the first and third groups are led to the right side of the panel 1 and the Z electrodes Z2 and Z4 of the second and fourth groups are led to the left side of the panel 1, in other words, the Z electrodes are alternately led to the left and right sides of the panel.

In the foregoing, the PDP device of the second embodiment has been described. Note that the modification example described in the first embodiment can be applied to the ALIS PDP device of the second embodiment.

(Note 1)

In a driving method of a plasma display panel comprising: a plurality of first, second, and third electrodes which are disposed to be adjacent to each other and extending in a first direction, the third electrodes being provided respectively between the first and second electrodes between which discharges are to be repeated; and a dielectric layer which covers the plurality of first, second, and third electrodes, grayscale display is carried out by means of a sub-field method in which the numbers of repeated discharges are allotted to sub-fields in accordance with a luminance ratio, and at least one sub-field from the sub-field of minimum luminance has luminance lower than luminance corresponding to the number of the repeated discharges. (1)

(Note 2)

In a driving method of a plasma display panel comprising: a plurality of first, second, and third electrodes which are disposed to be adjacent to each other and extending in a first direction, the third electrodes being provided respectively between the first and second electrodes between which discharges are to be repeated; and a dielectric layer which covers the plurality of first, second, and third electrodes, grayscale display is carried out by means of a sub-field method, and the third electrodes are set to have a potential which is approximately the same as the potential of one of the first and second electrodes at least at the time of the discharges during a period when the discharges are repeated between the first and second electrodes, and in at least one sub-field from the sub-field of minimum luminance, at least one repeated discharge is a discharge in which the third electrodes operate as anodes, and the rest of the repeated discharges are discharges in which the third electrodes operate as cathodes. (2)

(Note 3)

In the driving method of a plasma display panel according to note 2, the repeated discharges of the sub-field of high luminance are discharges in which the third electrodes operate as cathodes all the time. (3)

(Note 4)

In the driving method of a plasma display panel according to note 2, in the at least one sub-field from the sub-field of minimum luminance, the third electrodes operate as cathodes at the time of the first discharge in the repeated discharge period. (4)

(Note 5)

In the driving method of a plasma display panel according to note 4, when a state where the third electrodes operate as cathodes is to be switched to a state where the third electrodes operate as anodes in the period when the discharges are repeated, potential of the third electrodes is changed in synchronization with a potential change of the first or second electrodes which are to be subsequently operated as anodes. (5)

(Note 6)

In the driving method of a plasma display panel according to note 2, the ratio of the number of discharges in which the third electrodes operate as anodes to the number of repeated discharges is increased in the sub-field of lower luminance.

(Note 7)

In a plasma display device comprising: a plasma display panel including a plurality of first, second, and third electrodes which are disposed to be adjacent to each other and extending in a first direction, the third electrodes being provided respectively between the first and second electrodes between which discharges are to be repeated, and a dielectric layer which covers the plurality of first, second, and third electrodes; a first electrode driving circuit for driving the plurality of first electrodes; a second electrode driving circuit for driving the plurality of second electrodes; and a third electrode driving circuit for driving the plurality of third electrodes, grayscale display is carried out by means of a sub-field method in which the numbers of repeated discharges are allotted to sub-fields in accordance with a luminance ratio, and at least one sub-field from the sub-field of minimum luminance has luminance lower than luminance corresponding to the number of the repeated discharges. (6)

(Note 8)

In a plasma display device comprising: a plasma display panel including a plurality of first, second, and third electrodes which are disposed to be adjacent to each other and extending in a first direction, the third electrodes being provided respectively between the first and second electrodes between which discharges are to be repeated, and a dielectric layer which covers the plurality of first, second, and third electrodes; a first electrode driving circuit for driving the plurality of first electrodes; a second electrode driving circuit for driving the plurality of second electrodes; and a third electrode driving circuit for driving the plurality of third electrodes, grayscale display is carried out by means of a sub-field method, and the third electrodes are set to have a potential which is approximately the same as the potential of one of the first and second electrodes at least at the time of the discharges during a period when the discharges are repeated between the first and second electrodes, and in at least one sub-field from the sub-field of minimum luminance, the third electrode driving circuit makes the third electrodes operate as anodes in at least one repeated discharge, and the third electrode driving circuit makes the third electrodes operate as cathodes in the rest of the repeated discharges. (7)

(Note 9)

In the plasma display device according to note 8, the third electrode driving circuit makes the third electrodes operate only as cathodes in the repeated discharge period in the sub-field of high luminance. (8)

(Note 10)

In the plasma display device according to note 8, the third electrode driving circuit makes the third electrodes operate as cathodes at the time of the first discharge in the repeated discharge period. (9)

(Note 11)

In the plasma display device according to note 10, when a state where the third electrodes operate as cathodes is to be switched to a state where the third electrodes operate as anodes in the period when the discharges are repeated, the third electrode driving circuit changes potential of the third electrodes in synchronization with a potential change of the first or second electrodes which are to be subsequently operated as anodes. (10)

(Note 12)

In the plasma display device according to note 8, the third electrode driving circuit controls the ratio of the number of discharges in which the third electrodes operate as anodes to the number of repeated discharges so that it is increased in the sub-field of lower luminance.

(Note 13)

In the plasma display device according to Note 8, the plurality of first and second electrodes form pairs, and the third electrode is provided between the first electrode and the second electrode of each pair, and the third electrode driving circuit applies a common potential to the plurality of third electrodes.

(Note 14)

In the plasma display device according to Note 8, the plurality of third electrodes are provided between all of the plurality of first electrodes and the plurality of second electrodes, and an odd-number field in which repetitive discharges for display are performed between the second electrodes and the first electrodes adjacent to one side of the second electrodes and an even-number field in which the repetitive discharges for display are performed between the second electrodes and the first electrodes adjacent to the other side of the second electrodes are provided.

As described above, according to the present invention, the driving method of a PDP and the plasma display device in which grayscale display is improved by making the display of low-grayscale part fine are realized. Consequently, it is possible to provide a plasma display panel which can realize a PDP device with a good display quality at low cost.

What is claimed is:

1. A driving method of a plasma display panel comprising: a plurality of first, second, and third electrodes which are disposed to be adjacent to each other and extending in a first direction, said third electrodes being provided respectively between said first and second electrodes between which discharges are to be repeated; and a dielectric layer which covers said plurality of first, second, and third electrodes, wherein grayscale display is carried out by means of a sub-field method in which the numbers of repeated discharges are allotted to sub-fields in accordance with a luminance ratio, and at least one sub-field from the sub-field of minimum luminance has luminance lower than luminance corresponding to said number of the repeated discharges.

2. A driving method of a plasma display panel comprising: a plurality of first, second, and third electrodes which are disposed to be adjacent to each other and extending in a first direction, said third electrodes being provided respectively between said first and second electrodes between which discharges are to be repeated; and a dielectric layer which covers said plurality of first, second, and third electrodes, wherein grayscale display is carried out by means of a sub-field method, and said third electrodes are set to have a potential which is approximately the same as the potential of one of said first and second electrodes at least at the time of the discharges during a period when the discharges are repeated between said first and second electrodes, and in at least one sub-field from the sub-field of minimum luminance, at least one repeated discharge is a discharge in which said third electrodes operate as anodes, and the rest of said repeated discharges are discharges in which said third electrodes operate as cathodes.

3. The driving method of a plasma display panel according to claim 2, wherein said repeated discharges of the sub-field of high luminance are discharges in which said third electrodes operate as cathodes all the time.

4. The driving method of a plasma display panel according to claim 2, wherein, in the at least one sub-field from the sub-field of minimum luminance, said third electrodes operate as cathodes at the time of the first discharge in said repeated discharge period.

5. The driving method of a plasma display panel according to claim 4, wherein, when a state where said third electrodes operate as cathodes is to be switched to a state where said third electrodes operate as anodes in the period when said discharges are repeated, potential of said third electrodes is changed in synchronization with a potential change of said first or second electrodes which are to be subsequently operated as anodes.

6. A plasma display device comprising:

a plasma display panel including a plurality of first, second, and third electrodes which are disposed to be adjacent to each other and extending in a first direction, said third electrodes being provided respectively between said first and second electrodes between which discharges are to be repeated, and a dielectric layer which covers said plurality of first, second, and third electrodes;

a first electrode driving circuit for driving said plurality of first electrodes;

a second electrode driving circuit for driving said plurality of second electrodes; and a third electrode driving circuit for driving said plurality of third electrodes, wherein grayscale display is carried out by means of a sub-field method in which the numbers of repeated discharges are allotted to sub-fields in accordance with a luminance ratio, and at least one sub-field from the sub-field of minimum luminance has luminance lower than luminance corresponding to said number of the repeated discharges.

7. A plasma display device comprising:

a plasma display panel including a plurality of first, second, and third electrodes which are disposed to be adjacent to each other and extending in a first direction, said third electrodes being provided respectively between said first and second electrodes between which discharges are to be repeated, and a dielectric layer which covers said plurality of first, second, and third electrodes;

a first electrode driving circuit for driving said plurality of first electrodes;

a second electrode driving circuit for driving said plurality of second electrodes; and a third electrode driving circuit for driving said plurality of third electrodes, wherein grayscale display is carried out by means of a sub-field method, and said third electrodes are set to have a potential which is approximately the same as the potential of one of said first and second electrodes at least at the time of the discharges during a period when the discharges are repeated between said first and second electrodes, and in at least one sub-field from the sub-field of minimum luminance, said third electrode driving circuit makes said third electrodes operate as anodes in at least one repeated discharge, and said third electrode driving circuit makes said third electrodes operate as cathodes in the rest of said repeated discharges.

8. The plasma display device according to claim 7, wherein said third electrode driving circuit makes said third electrodes operate only as cathodes in said repeated discharge period in the sub-field of high luminance.

9. The plasma display device according to claim 7, wherein said third electrode driving circuit makes the third electrodes operate as cathodes at the time of the first discharge in said repeated discharge period.

10. The plasma display device according to claim 9, wherein, when a state where said third electrodes operate as cathodes is to be switched to a state where said third electrodes operate as anodes in the period when said discharges are repeated, said third electrode driving circuit changes potential of said third electrodes in synchronization with a potential change of said first or second electrodes which are to be subsequently operated as anodes.

11. The plasma display device according to claim 7, wherein said third electrode driving circuit controls the ratio of the number of discharges in which said third electrodes operate as anodes to the number of repeated discharges so that it is increased in the sub-field of lower luminance.

12. The plasma display device according to claim 7, wherein said plurality of first and second electrodes form pairs, and said third electrode is provided between said first electrode and said second electrode of each pair, and said third electrode driving circuit applies a common potential to said plurality of third electrodes.

13. The plasma display device according to claim 7, wherein said plurality of third electrodes are provided between all of said plurality of first electrodes and said plurality of second electrodes, and an odd-number field in which repetitive discharges for display are performed between said second electrodes and said first electrodes adjacent to one side of said second electrodes and an even-number field in which the repetitive discharges for display are performed between said second electrodes and said first electrodes adjacent to the other side of said second electrodes are provided.

* * * * *

UNITED STATES PATENT AND TRADEMARK OFFICE

CERTIFICATE OF CORRECTION

PATENT NO. : 7,573,440 B2
APPLICATION NO. : 11/327501
DATED : August 11, 2009
INVENTOR(S) : Sasaki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 849 days.

Signed and Sealed this

Seventh Day of September, 2010

David J. Kappos

David J. Kappos
*Director of the United States Patent and Trademark Office*